US011773599B2

(12) United States Patent
Pursley, Jr.

(10) Patent No.: US 11,773,599 B2
(45) Date of Patent: Oct. 3, 2023

(54) SYSTEMS, DEVICES, AND METHODS FOR MOUNTING A LIGHTWEIGHT ARCHITECTURAL MASONRY PRODUCT TO A BUILDING

(71) Applicant: Piazza Stone, LLC, Augusta, GA (US)

(72) Inventor: Norman Brundage Pursley, Jr., Augusta, GA (US)

(73) Assignee: Piazza Stone, LLC, Augusta, GA (US)

( * ) Notice: Subject to any disclaimer, the term of this patent is extended or adjusted under 35 U.S.C. 154(b) by 0 days.

(21) Appl. No.: 17/928,152

(22) PCT Filed: Feb. 11, 2022

(86) PCT No.: PCT/US2022/016155
§ 371 (c)(1),
(2) Date: Nov. 28, 2022

(87) PCT Pub. No.: WO2022/174061
PCT Pub. Date: Aug. 18, 2022

(65) Prior Publication Data

US 2023/0220678 A1 Jul. 13, 2023

Related U.S. Application Data

(60) Provisional application No. 63/149,139, filed on Feb. 12, 2021.

(51) Int. Cl.
*E04B 2/00* (2006.01)
*E04F 13/08* (2006.01)
*E04F 13/14* (2006.01)

(52) U.S. Cl.
CPC ..... *E04F 13/0821* (2013.01); *E04F 13/14* (2013.01)

(58) Field of Classification Search
CPC ..... E04F 13/0821; E04F 13/14
(Continued)

(56) References Cited

U.S. PATENT DOCUMENTS 3,234,702 A * 2/1966 Jules ..... E04B 1/5806 52/379
4,870,794 A * 10/1989 Menchetti ..... E04B 2/7409 52/489.2

(Continued)

FOREIGN PATENT DOCUMENTS

GB 2393978 A 4/2004

OTHER PUBLICATIONS

International Search Report and Written Opinion corresponding to International Patent Application No. PCT/US2022/016155 dated May 13, 2022.

*Primary Examiner* — Basil S Katcheves
(74) *Attorney, Agent, or Firm* — Jenkins, Taylor & Hunt, P.A.

(57) ABSTRACT

The present subject matter relates to systems, devices, and methods for mounting one or more lightweight architectural masonry units to a building support structure. An elongated track includes a web and opposed edge portions that form a pair of slide channels, the elongated track being configured to be mounted to the building support structure. A connecting member includes a base portion configured to retain the connecting member to the channels but is movable within the channels along the track, and a flange portion is configured to connect to a first lightweight architectural masonry unit of the one or more lightweight architectural masonry units. A fixation member includes a first end configured to connect to the elongated track and a second end configured to connect to the lightweight architectural masonry unit, the fixation member being configured to retain the first light- (Continued)

weight architectural masonry unit in place relative to the elongated track.

33 Claims, 27 Drawing Sheets

(58) Field of Classification Search
USPC ..... 52/506.05
See application file for complete search history.

(56) References Cited

U.S. PATENT DOCUMENTS 5,224,322 A * 7/1993 van den Toorn ..... E04B 2/7409 52/489.1
5,313,752 A * 5/1994 Hatzinikolas ..... E04B 2/58 52/690
5,740,646 A 4/1998 Wirkus et al.
5,846,018 A * 12/1998 Frobosilo ..... E04F 13/0808 403/231
6,213,679 B1 * 4/2001 Frobosilo ..... E04B 2/96 403/14
6,763,644 B1 7/2004 Toledo
7,478,508 B2 * 1/2009 Peterson ..... E04B 2/96 248/300
7,587,870 B2 * 9/2009 Voegele, Jr. ..... E04C 1/42 52/456
8,511,032 B2 * 8/2013 Abdel-Rahman ..... E04B 2/88 52/573.1
9,663,948 B2 * 5/2017 Lehane ..... E04B 9/30
D822,454 S * 7/2018 Kanter ..... D8/354
10,087,617 B2 * 10/2018 Daudet ..... F16M 13/02
10,584,489 B2 * 3/2020 Bergman ..... E04B 9/20
10,724,229 B2 * 7/2020 Daudet ..... E04B 1/2403
2005/0229529 A1 * 10/2005 Frascari ..... F16B 7/22 52/509
2007/0039261 A1 * 2/2007 Girardi ..... E04C 1/42 52/306
2007/0193154 A1 * 8/2007 Voegele ..... E04C 1/42 52/308
2008/0296451 A1 * 12/2008 Yoshida ..... E04F 13/0808 248/220.1
2009/0084053 A1 * 4/2009 Hikai ..... E04F 13/0736 52/741.1

* cited by examiner

SYSTEMS, DEVICES, AND METHODS FOR MOUNTING A LIGHTWEIGHT ARCHITECTURAL MASONRY PRODUCT TO A BUILDING

CROSS-REFERENCE TO RELATED APPLICATIONS

This application is a national phase application of PCT International Patent Application No. PCT/US2022/016155, filed Feb. 11, 2022, herein incorporated by reference its entirety, and which claims priority to and the benefit of U.S. Patent Application Ser. No. 63/149,139, filed Feb. 12, 2021, the disclosure of which is incorporated herein by reference in its entirety.

TECHNICAL FIELD

The subject matter disclosed herein relates generally to systems, devices, and methods for attaching architectural building elements together. More particularly, the subject matter disclosed herein relates to systems, devices, and methods for mounting one or more lightweight architectural masonry units to a building support structure.

BACKGROUND

Architectural cast stone is a class of masonry products that are designed to replicate the look of stone construction when used as an architectural trim, feature, or ornament for buildings and other structures. In many configurations, such products are not designed to support the building structure or load bearing elements, though, and therefore must be mounted to the load-bearing elements of the structure. Traditional cast-stone systems can be very heavy and require significant structural steel connections to the structure using welds, bolts, anchors, diagonal kickers, and the like.

To address some of these issues with traditional cast-stone systems, lightweight architectural masonry units produced using a combination of a lightweight stone or stone-like shell and an expanded polystyrene (EPS) core can provide a similar look and durability with dramatically lower weight. Originally, an adhesive attachment to the structure was considered, but adhesives are not a trusted attachment mechanism for an architectural stone system such as this. Split-tail connectors are frequently used in masonry and cast-stone construction, but such connectors are not sufficient for the varied and complex geometrical constraints of the lightweight architectural masonry products contemplated by the present subject matter. As a result, it is desirable for mounting systems, devices and methods to enable the installation of lightweight architectural masonry products in a more efficient and flexible manner than traditional cast-stone products.

SUMMARY

In accordance with this disclosure, systems, devices, and methods for mounting one or more lightweight architectural masonry units to a building support structure are provided. In one aspect, a connector assembly for mounting one or more lightweight architectural masonry units to a building support structure is provided. The connector assembly includes an elongated track, a connecting member, and a fixation member. The elongated track includes a web and opposed edge portions that extend in a first direction from a first surface of the web and that form a pair of slide channels, the elongated track being configured to be mounted to the building support structure. The connecting member includes a base portion and a flange portion, the base portion being configured to retain the connecting member to the channels but is movable within the channels along the track, and the flange portion being configured to connect to a first lightweight architectural masonry unit of the one or more lightweight architectural masonry units. The fixation member includes a first end configured to connect to the elongated track and a second end configured to connect to the first lightweight architectural masonry unit, the fixation member configured to retain the first lightweight architectural masonry unit in place with respect to the elongated track.

In another aspect, an assembly of one or more lightweight architectural masonry units configured for mounting to a building support structure is provided. The assembly includes an elongated track having a web and opposed edge portions that extend in a first direction from a first surface of the web and that form a pair of slide channels, the elongated track being configured to be mounted to the building support structure. A connecting member includes a base portion and a flange portion, the base portion being configured to retain the connecting member to the channels but is movable within the channels along the track. A first lightweight architectural masonry unit of the one or more lightweight architectural masonry units is attached to the flange portion of the connecting member. A fixation member has a first end connected to the elongated track and a second end connected to the first lightweight architectural masonry unit, the fixation member configured to retain the first lightweight architectural masonry unit in place with respect to the elongated track.

In yet a further aspect, a method for mounting one or more lightweight architectural masonry units to a building support structure is provided. The method includes mounting an elongated track to the building support structure, the elongated track being having a web and opposed edge portions that extend in a first direction from a first surface of the web and that form a pair of slide channels. The method further incudes positioning a connecting member in the slide channels, the connecting member including a base portion and a flange portion, the base portion retaining the connecting member to the channels but being movable within the channels along the track. The method further includes connecting the flange portion of the connecting member to a first lightweight architectural masonry unit of the one or more lightweight architectural masonry units. The method further includes connecting a first end of a fixation member to the elongated track and connecting a second end of the fixation member to the first lightweight architectural masonry unit, the fixation member retaining the first lightweight architectural masonry unit in place with respect to the elongated track.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1A:
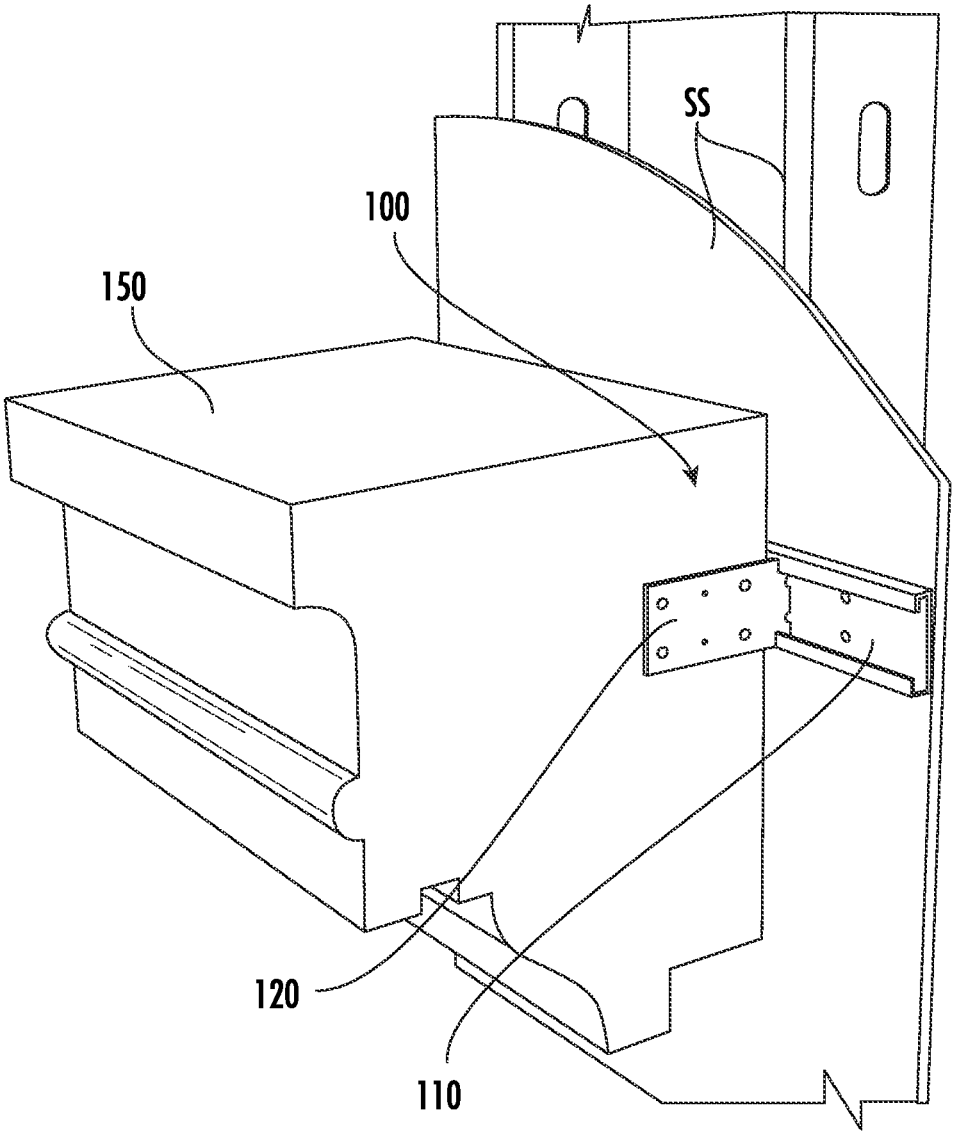
FIGS. 1A and 1B are perspective side views of assemblies of a lightweight architectural masonry unit mounted to a building support structure according to embodiments of the presently disclosed subject matter.

The present subject matter provides a stone attachment mechanism specifically developed to attach lightweight decorative stone pieces to a structure by the use of formed metal clips. The system includes specific connector configurations that have been designed to accommodate allowable fastener loads used in lightweight architectural masonry products. As used herein, the term "lightweight architectural masonry" refers to products produced using a combination of a lightweight stone or stone-like shell and an expanded polystyrene (EPS) core or extruded polystyrene (XPS) core. In some embodiments, the shell is formed from any of a variety of material compositions, including but not limited to blended marble aggregate, polymers, and/or wet poured in-place concrete, which individually or together in combination are made to look like stone. Such a configuration can produce a shell that is quite strong (6850 psi) and thus yields high fastener attachment shear and tensile values. This in turn enables compact clip connections to carry the load back to the structure.

It is also unique in that by using a combination of a lightweight stone or stone-like shell and an expanded polystyrene (EPS) or extruded polystyrene (XPS) core, the thermal properties (measured in R-value) of the lightweight architectural masonry products are superior to that of traditional stone claddings. It combines the thermal properties of EPS (or XPS) with the structural properties of the architectural masonry and the structural properties of the steel connections to create a lightweight stone cladding system that is superior in terms of weight, structural performance, and thermal performance, and mounting such products exhibits improved assembly simplicity and lower installation cost of labor. Such decorative stone pieces can thus be readily attached on certain building features, such as parapets, soffits, door headers, outside and inside corners, and columns, among others.

In one aspect, the present subject matter provides systems, devices, and methods for mounting one or more lightweight architectural masonry units to a building support structure using a combination of connectors and a framing system adapted from light steel construction for the lightweight stone attachment conditions. In some embodiments, support structure and connectors can range from 54 mil-97 mil thickness and have a 50 ksi minimum yield strength and 65 ksi minimum tensile strength. In some embodiments, the support structure and/or connectors are composed of ASTM A1003/A1003M Structural Grade 50 (340) Type H, ST50H (ST340H) cold-formed structural parts carbon steel sheets with metallic and non-metallic coatings (e.g., ASTM A653/A653M G90 (Z275) hot dipped galvanized coating), although those having ordinary skill in the art will recognize that other material compositions and configurations can likewise be used to produce support and connections of sufficient strength to mount the lightweight architectural masonry units.

Figure 1B:
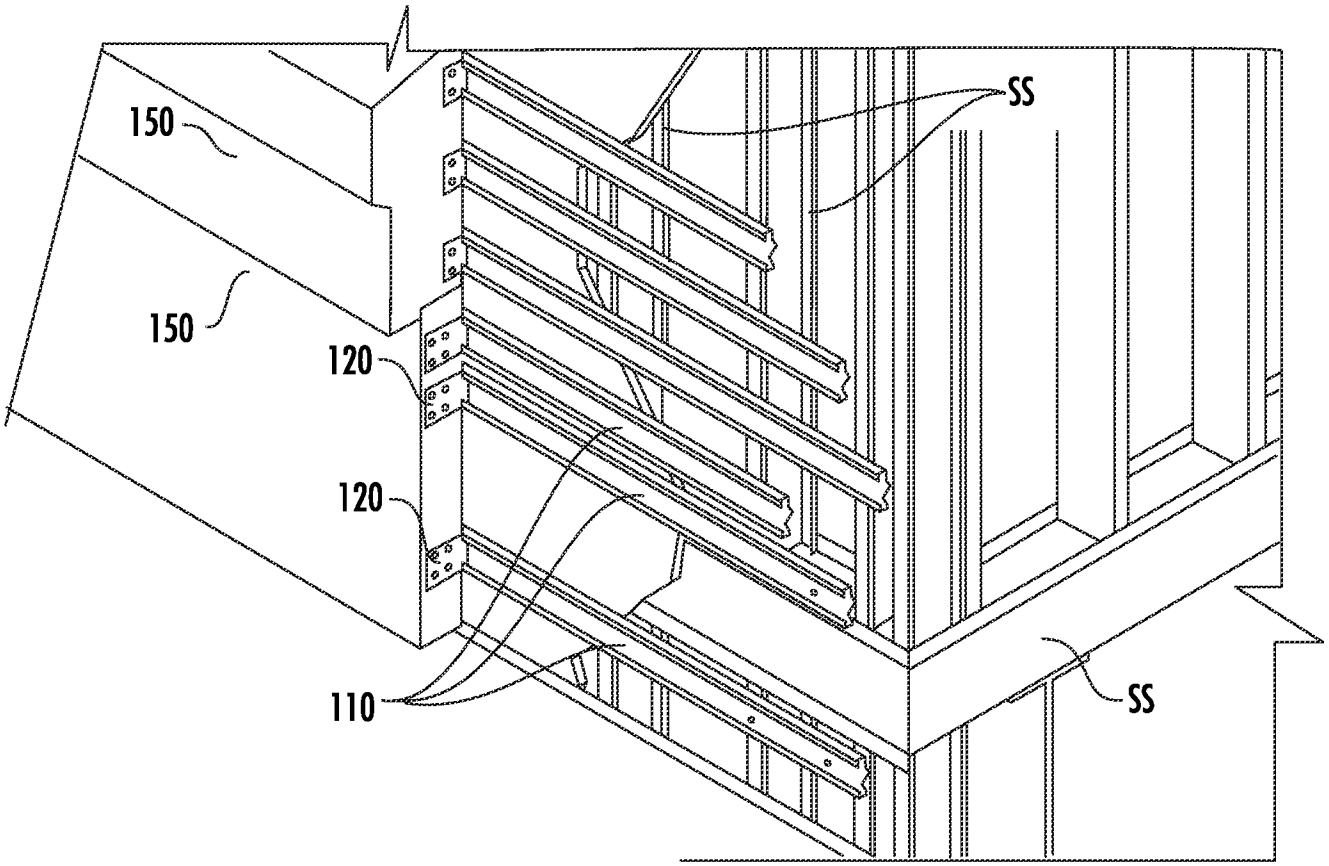

As shown in FIGS. 1A and 1B, in some embodiments, the connector assembly, generally designated 100, includes an elongated track 110 configured to be mounted to a building support structure, generally designated SS, and a connecting member 120 configured to connect to a first lightweight architectural masonry unit 150 of the one or more lightweight architectural masonry units. As shown in FIG. 1A, in some embodiments, a single elongated track 110 can be used to support the lightweight architectural masonry unit 150. In some embodiments, the specifications of the elongated track 110 (e.g., metal gauge, tensile strength) can be tailored to support the lightweight architectural masonry unit 150 having a particular size or configuration. Alternatively, referring to FIG. 1B, multiples of the elongated track 110 can be connected to the building support structure SS to support each lightweight architectural masonry unit 150 of the one or more lightweight architectural masonry units. Those having ordinary skill in the art will be able to identify the number of the elongated track 110 that are needed to support the lightweight architectural masonry unit 150 in a particular installation.

Figure 2:
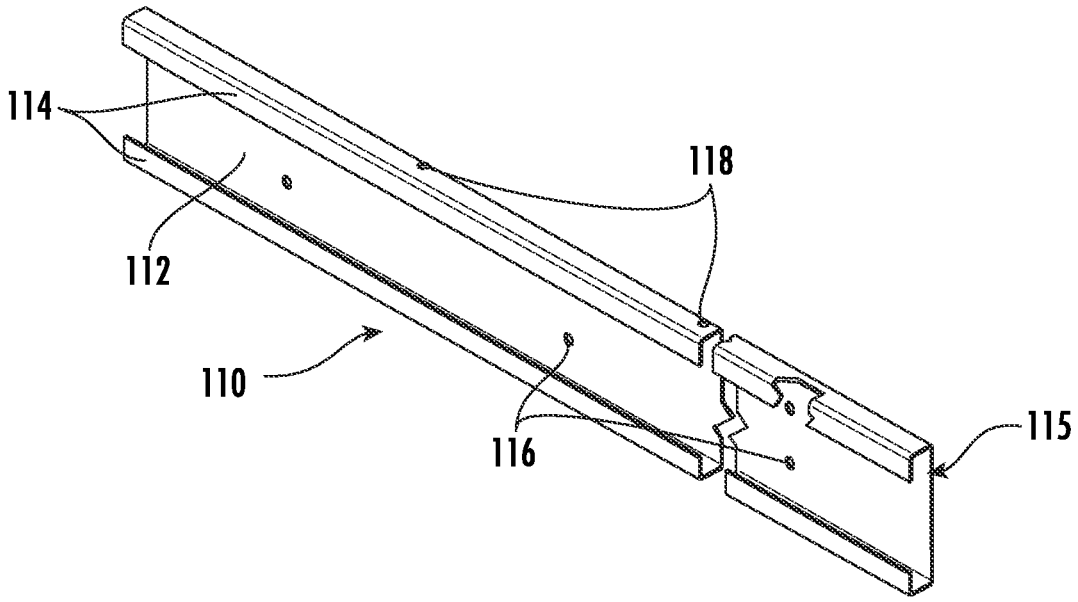
FIG. 2 is a perspective side view of an elongated track for a connector assembly according to an embodiment of the presently disclosed subject matter.

Referring to FIG. 2, the elongated track 110 has a web 112 and opposed edge portions 114 that extend in a first direction from a first surface of the web 112 and that form a pair of slide channels 115. In some embodiments, to mount the elongated track 110 to the building support structure SS, a plurality of holes 116 through the web 112 through which a corresponding plurality of fasteners can be received. Compared to conventional track-mounted building products, larger screws (e.g., about 0.225 inch) can be used such that the elongated track 110 is sufficiently able to transfer the load of the attached lightweight masonry unit 150 to the building support structure SS. In some embodiments, the elongated track 118 further includes weep holes 118 configured to allow for drainage behind the lightweight masonry unit 150 mounted thereto, which can help to prevent pooling and corrosion. In some embodiments, the weep holes 118 are offset laterally with respect to the holes 116 such that drainage passing into the track 110 is not aligned with the fasteners attaching the track 110 to the support structure SS. In some embodiments, for example, the weep holes 118 can be provided in alignment on both a top and an opposing bottom of the edge portions 114 and offset laterally with respect to the holes 116 such that a direct path is formed for water to flow through the slide channels 115 without passing over any attaching fastener secured through the holes 116. Such weep holes 118 can be spaced periodically along the length of the elongated track 110 (e.g., positioned every 8 inches along the length). In addition, the weep holes 118 can be approximately the same size as the holes 116 for ease of manufacture, or the weep holes 118 can be a different size configured to accommodate the amount of drainage expected for a given configuration.

Figure 3A:
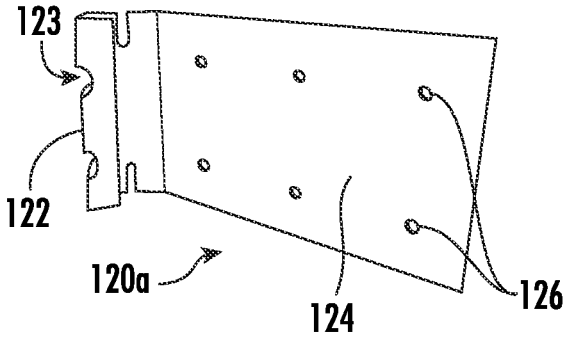
FIGS. 3A through 3C are perspective side views of connecting members of a connector assembly according to embodiments of the presently disclosed subject matter.
Figure 3B:
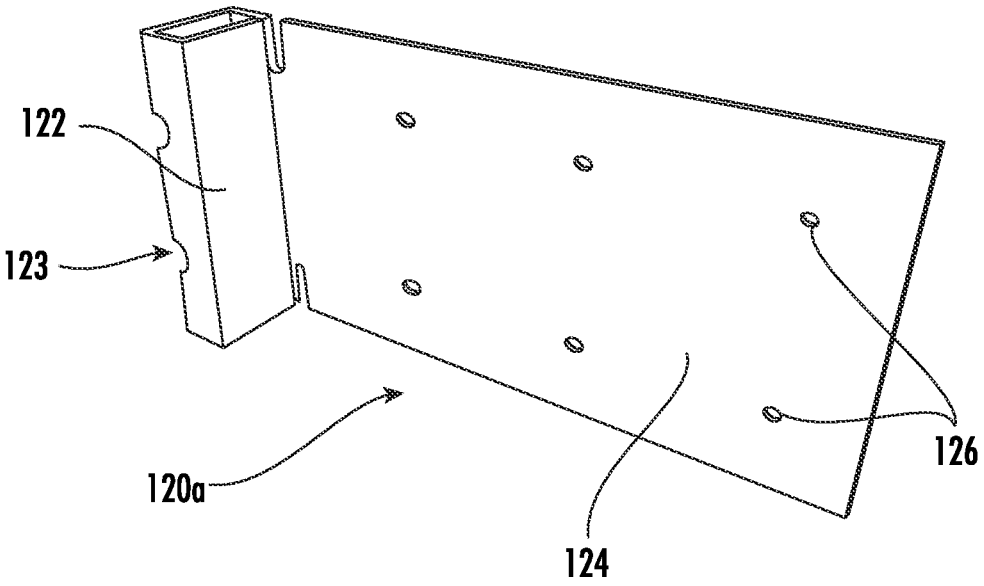
Figure 3C:
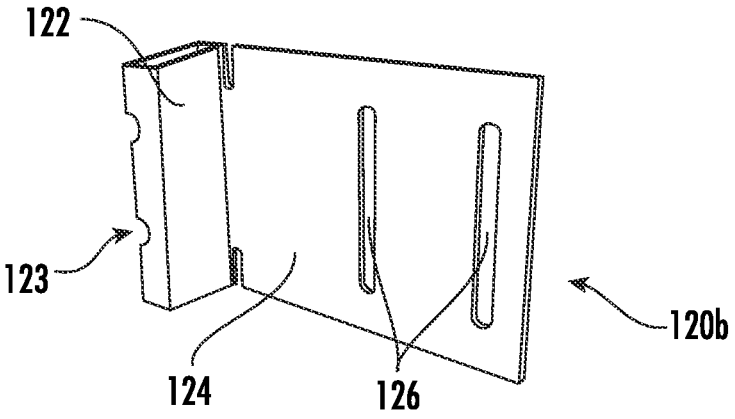

Referring next to FIGS. 3A through 3C, the connecting member 120 includes a base portion 122 that retains the connecting member to the channels 115 but is movable within the channels 115 along the track 110 and a flange portion 124 that extends from the base portion 122 and includes one or more fastener-receiving openings 126 such that the base portion 122 is configured to be affixed to the lightweight architectural masonry unit 150. To provide the ability for the connecting member 120 to move along the track 110, the connection between the base portion 122 and the flange portion 124 can include notches 123 formed into the base portion 122 in alignment with a position of fasteners used to mount the elongated track 110 to the building support structure SS. In this way, the notches 123 establish intermittent openings between the base portion 122 and the web 112 of the elongated track 110 through which the fasteners can pass as the connecting member 120 moves along the elongated track 110. FIGS. 3A through 3C illustrate different configurations for the flange portion 124 that are designed to be affixed to corresponding configurations of the lightweight architectural masonry unit 150. Those having ordinary skill in the art will recognize that the connecting member 120 can provided any of a variety of further configurations depending on the size and shape of the lightweight architectural masonry unit 150 to which it is designed to be affixed.

Similar track and clip configurations exist in the area of light steel frame construction, although the present subject matter differs in a number of respects. For example, in some embodiments, the thickness is reduced relative to conventional clip and frame elements to better match the weight of the lightweight stone panels. In some particular examples, the elements have a thickness of between about 54 mils and 97 mils, although those having ordinary skill in the art will recognize that the thickness of the elements can be adjusted (e.g., using any standard gauge of cold-formed steel having thicknesses between about 33 mils and 118 mils) to accommodate different configurations for the lightweight architectural masonry units.

Similarly, as shown in FIGS. 3A and 3B, in some embodiments, the connecting member 120 can be provided as a first connecting member configuration 120*a* that is affixed to the lightweight architectural masonry units 150 using fasteners that attach to the lightweight architectural masonry units through the one or more openings 126 that are provided as holes formed in the flange portion 124, and the size of these holes can be configured specifically to receive the connectors required by the stone material. Alternatively, as shown in FIG. 3C, in some other embodiments, the connecting member 120 can be provided as a second connecting member configuration 120*b* that is affixed to the lightweight architectural masonry unit 150 using fasteners that attach to the lightweight architectural masonry unit 150 through the openings 126 that are provides as slots that allow for vertical deflection. In some embodiments, for example, the openings 126 configured as slots are sized to allow for a total vertical displacement of about 2 inches. Again, the size of these slots can be configured specifically to receive the connectors required by the stone material.

In either configuration, the higher strength and lower thickness of the concrete shell used for the present lightweight architectural masonry units leads to smaller concrete failure cones, which in turn allows for tighter groups of fasteners attaching the connecting member 120 to the lightweight architectural masonry unit 150. In this way, the present configurations provide more fastening capacity in a tight space. Specifically, for example, the fasteners can be attached at or near an edge (e.g., within a range of about 0.75" to 3" from the edge) of the lightweight architectural masonry unit 150 without a reduction in the fastener capacity. In addition, the center-to-center distances of the openings 126 in the connecting member 120 can be reduced relative to conventional attachment configurations for stone materials (e.g., within a range of about 0.5" to 4.5") without a reduction in the fastener capacity. This compactness of the attachment between the connecting member 120 and the lightweight architectural masonry unit 150 enables the present connector assemblies 100 to engage a side-facing surface of the lightweight architectural masonry unit 150 rather than a rear-facing surface (where there may be no viable way to facilitate attachment) or a forward-facing surface (which is meant to be decorative). Such an arrangement is still able to readily support the weight of the lightweight architectural masonry unit 150. For instance, as indicated in an ASTM E488 test of one exemplary configuration of the present connector assemblies, an average ultimate tested load for a 3/16" concrete screw in tension in 1" of the present lightweight architectural masonry unit 150 is 553 lbs, and an average ultimate tested load for a 3/16" concrete screw in shear in 1" of the lightweight architectural masonry unit 150 is 369 lbs.

In either configuration, in some embodiments, the size of the notches 123 formed in the base portion 122 are configured to accommodate larger fasteners attaching the track 110 to the structure SS such that the elongated track 110 is sufficiently able to transfer the load of the attached stone material to the building support structure SS. For example, where the fasteners attaching the track 110 to the structure SS are 0.225 inch screws, the notches 123 can have a size of approximately ½ inch to accommodate the size of the corresponding screw head.

Figure 4:
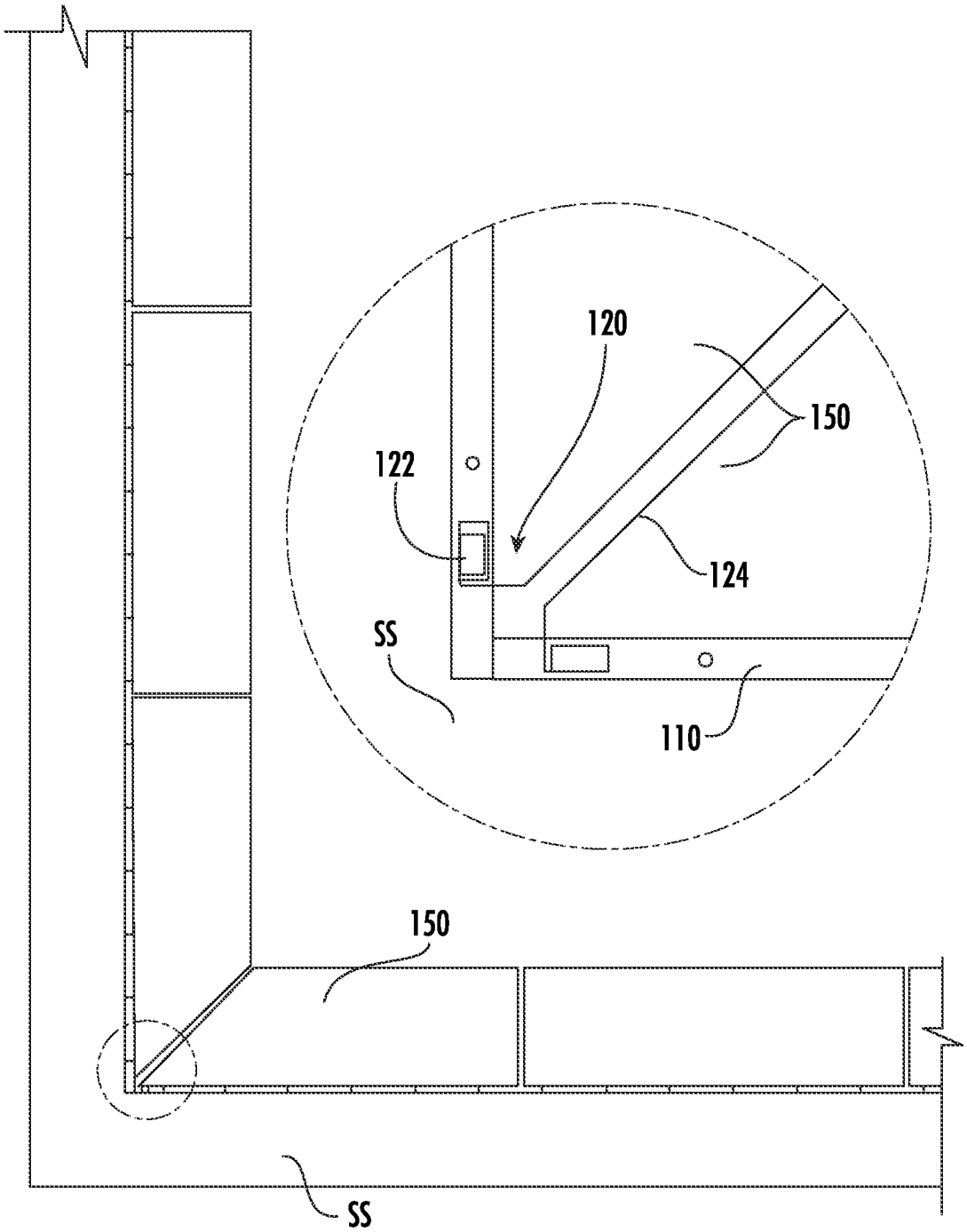
FIG. 4 is a top plan view of a connecting member of a connector assembly according to an embodiment of the presently disclosed subject matter.

In addition, as illustrated in FIG. 4, in some embodiments, the connecting member 120 can be configured to have an extra bend to allow an interior corner attachment. In this regard, the flange portion 124 of the connecting member 120 can be arranged at an oblique angle with respect to the base portion 122. In some embodiments, for example, the flange portion 124 can be configured to extend away from the track 110 at an angle of approximately 45° for connection with a correspondingly-angled side of a lightweight architectural masonry unit 150 used at an inside corner of a structure. In this way, the formed metal connectors can be designed specifically to optimize manufacturing needs and attachment to the structure through the use of novel shapes.

Figure 5:
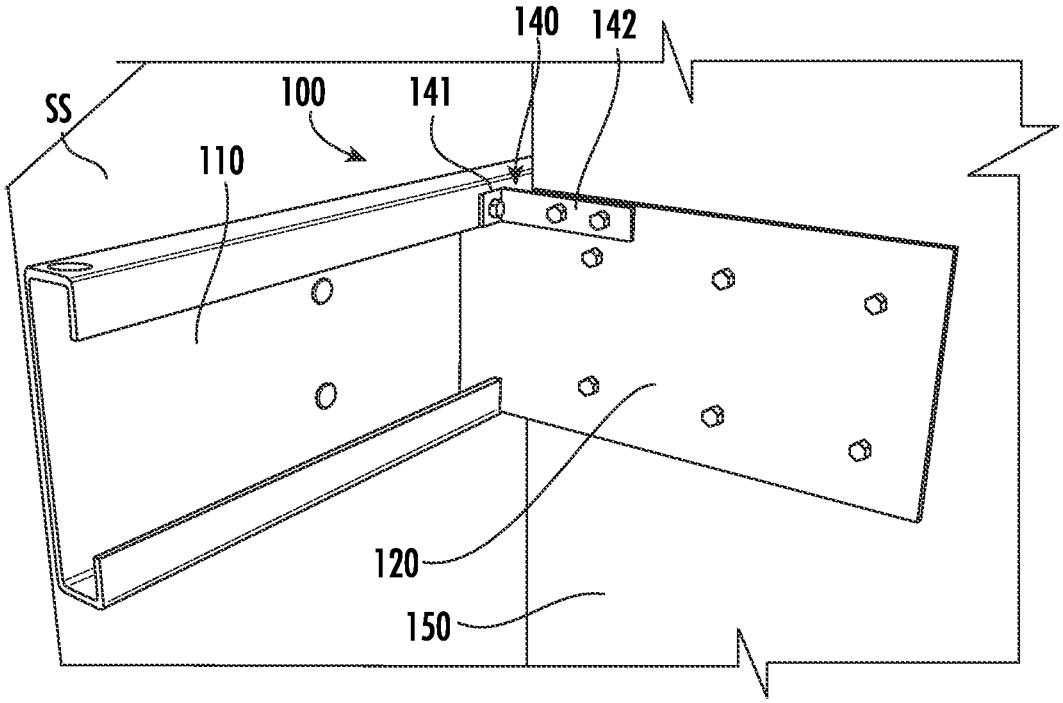
FIG. 5 is a perspective side view of a connector assembly according to an embodiment of the presently disclosed subject matter.

In any configuration, once the lightweight architectural masonry unit 150 is moved to a desired position with respect to the elongated track 110 and the building support structure SS (e.g., by sliding the assembly of one or more connecting member 120 attached to the lightweight architectural masonry unit 150 along the track 110), as illustrated in FIG. 5, in some embodiments, the connector assembly 100 further includes a fixation member 140 having a first end 141 configured to connect to the elongated track 110 and a second end 142 configured to connect to the connecting member 120 and/or to the lightweight architectural masonry unit 150. The fixation member 140 is configured to retain the first lightweight architectural masonry unit 150 in place with respect to the elongated track 110. In some embodiments, the first end 141 extends a length selected to correspond to a desired joint spacing between adjacent lightweight architectural masonry unit 150. For example, in some embodiments, the first end 141 extends approximately ½ inches to correspond to a joint spacing of approximately ⅝ inches between lightweight architectural masonry units 150, although those having ordinary skill in the art will recognize that the size, shape, and/or configuration of these elements is adjustable to accommodate different configurations of lightweight architectural masonry units 150.

Figure 6A:
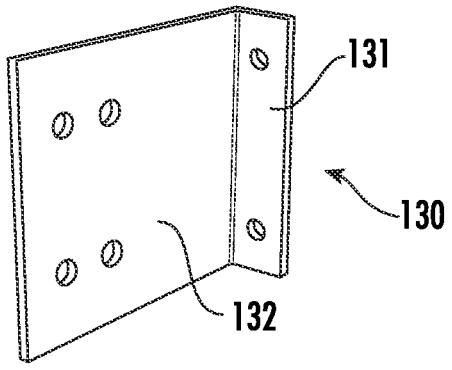
FIGS. 6A and 6B are perspective side views of web clips for connector assemblies according to embodiments of the presently disclosed subject matter.
Figure 6B:
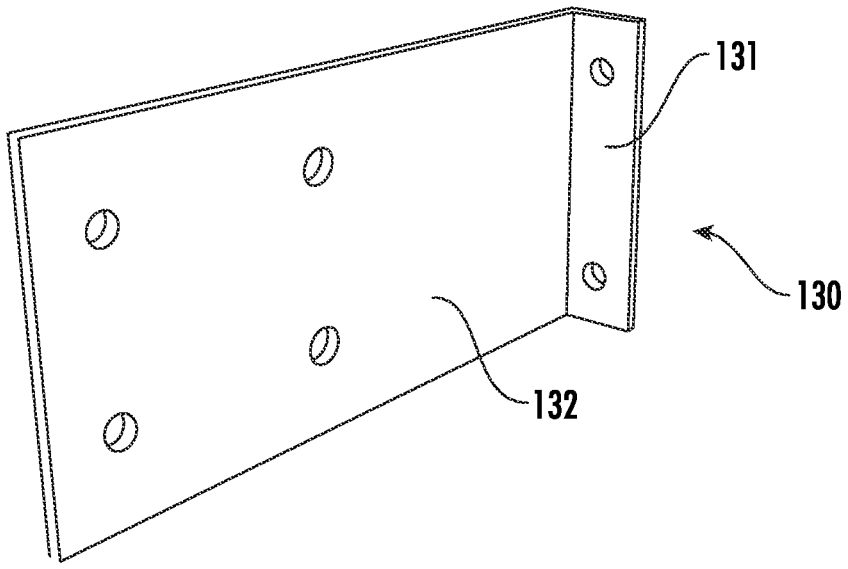
Figure 7A:
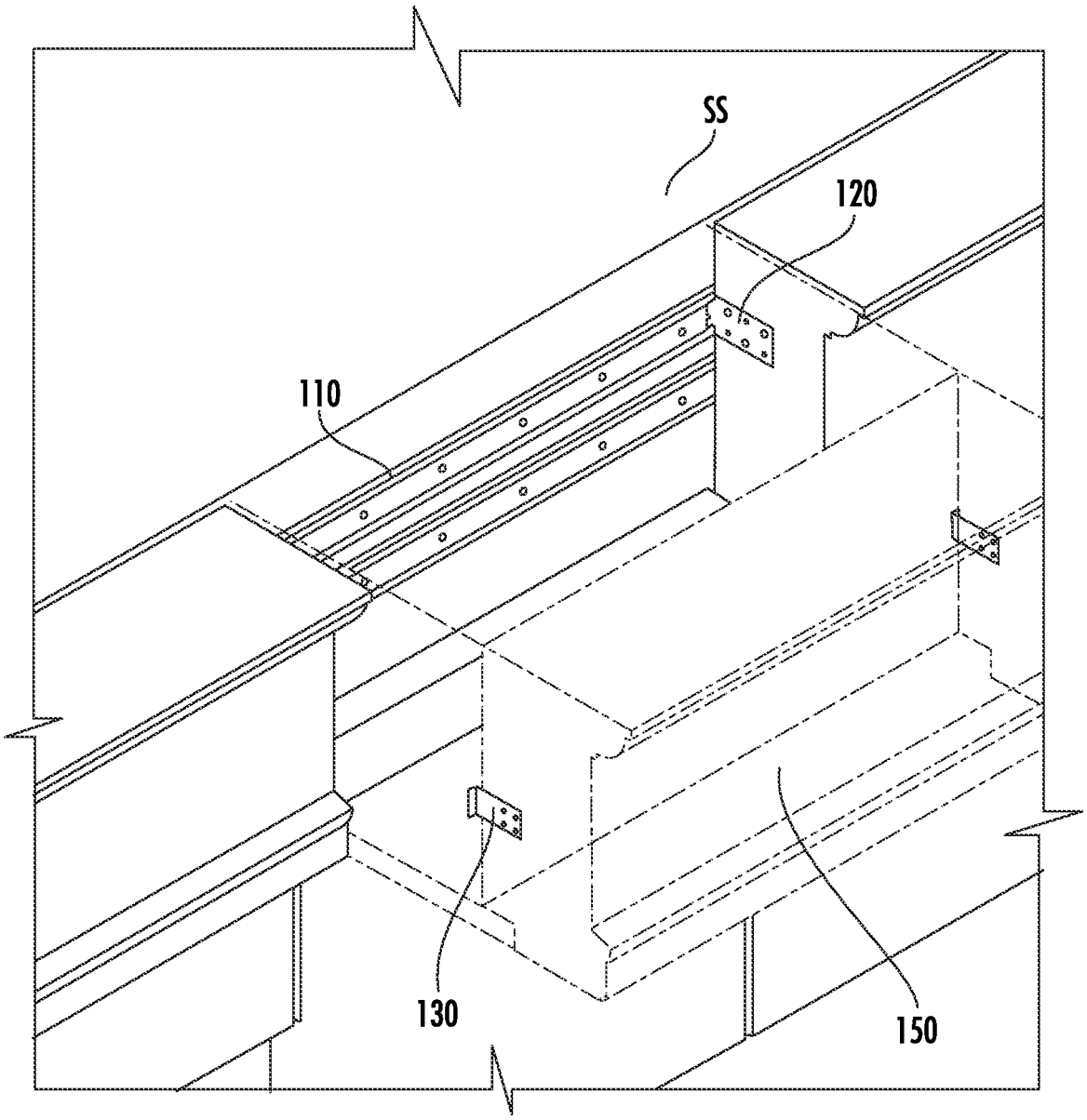
FIGS. 7A and 7B are perspective side views of connector assemblies according to embodiments of the presently disclosed subject matter.
Figure 7B:
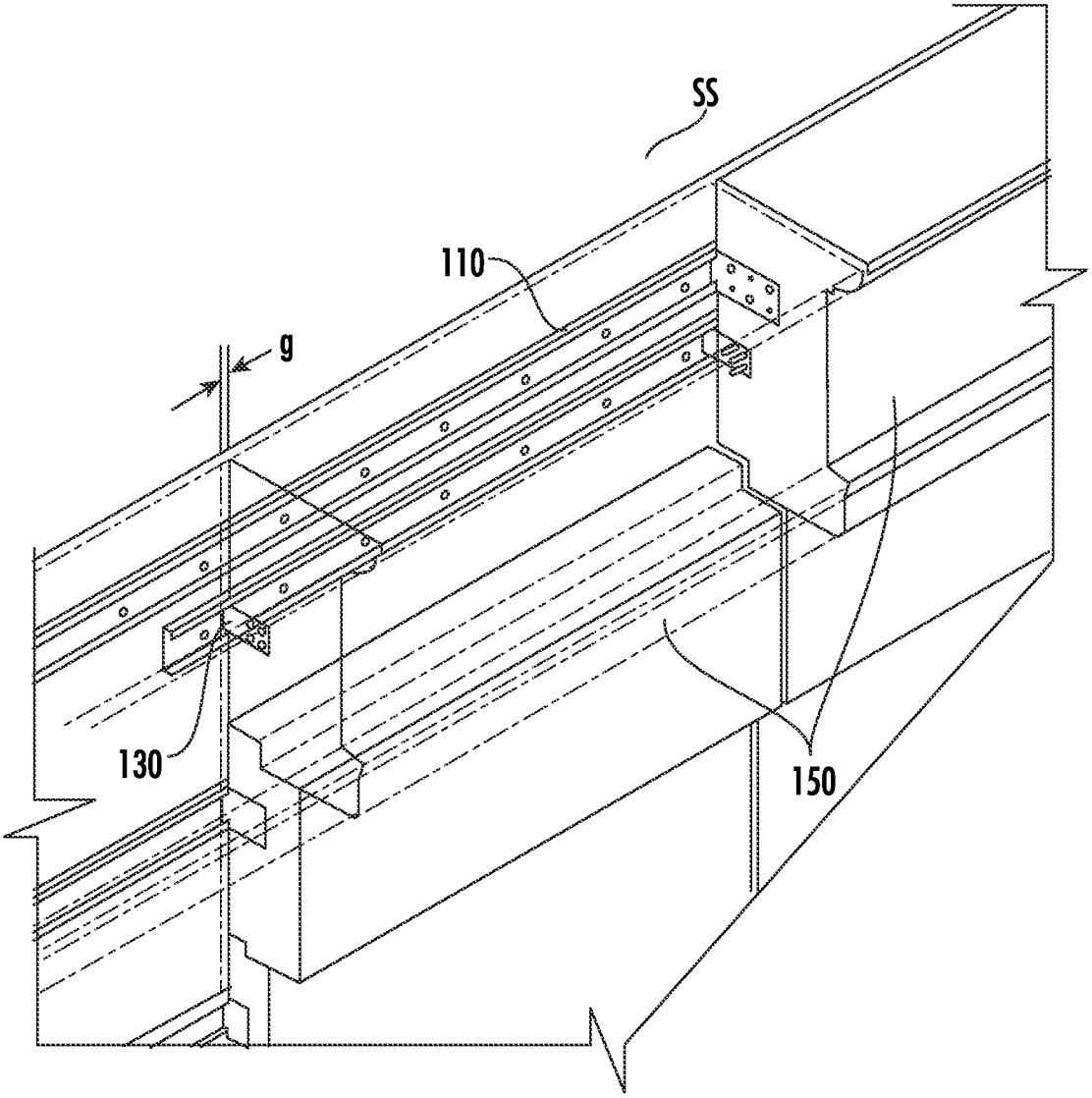
Figure 8:
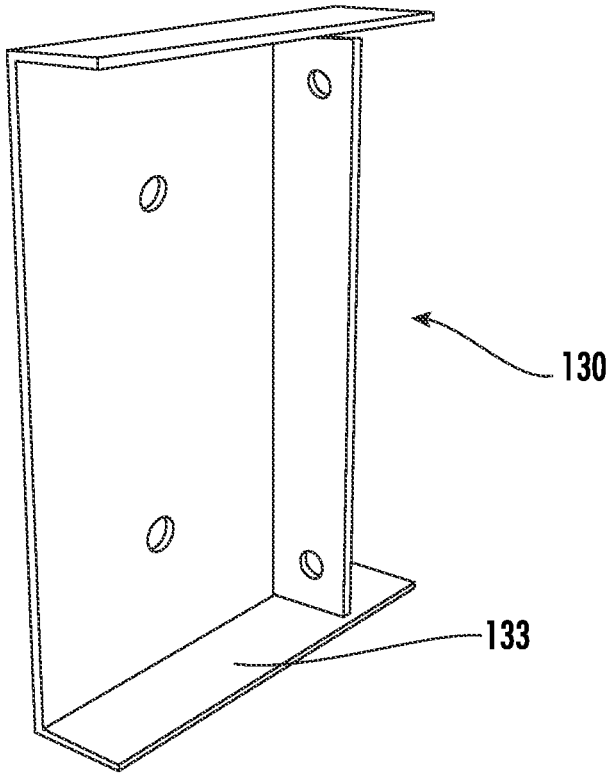
FIG. 8 is a perspective side view of a fixation member for a connector assembly according to an embodiment of the presently disclosed subject matter.
Figure 9:
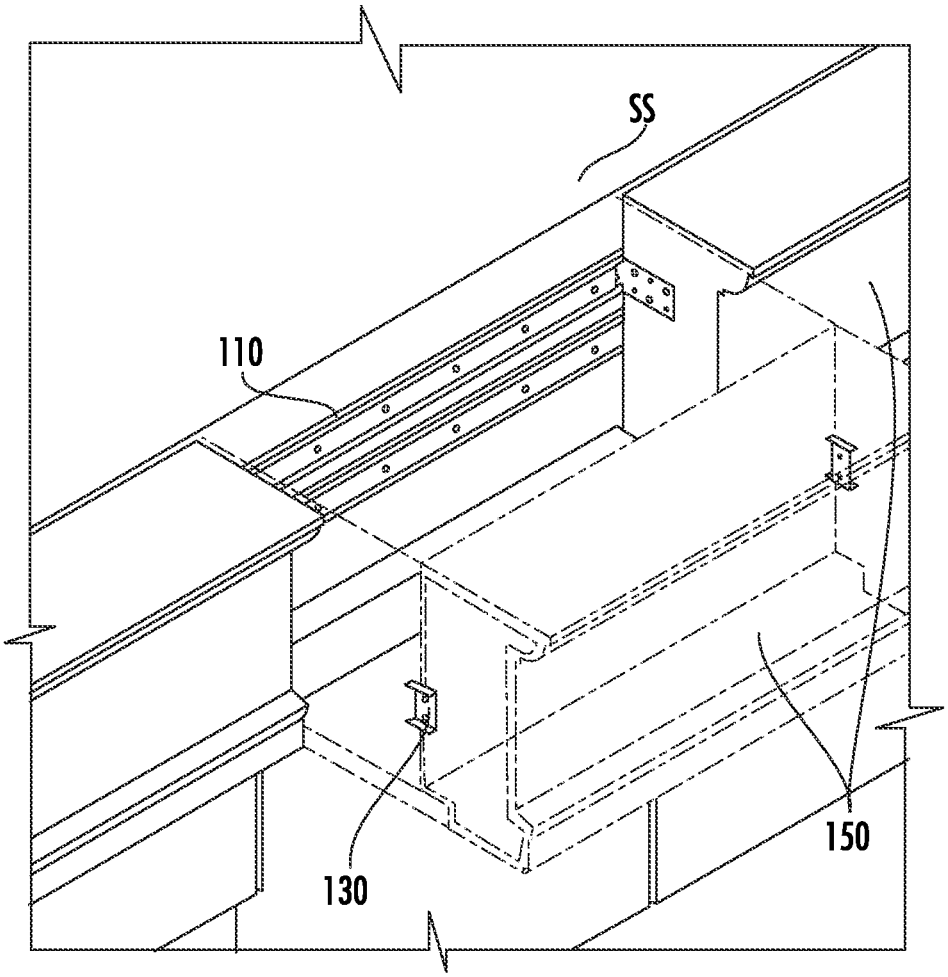
FIG. 9 is a perspective side view of a connector assembly according to an embodiment of the presently disclosed subject matter.

In a further aspect, additional connector configurations can be used in place of or in addition to those discussed above to mount the one or more lightweight architectural masonry units 150 to the building support structure SS. As shown in FIGS. 6A and 6B, in some embodiments, some of the one or more lightweight architectural masonry units 150 can be attached to the elongated track 110 using one or more web clips 130 that include a heel portion 131 configured to attach within the web 112 of the elongated track 110 and a flange portion 132 that is configured to attach to the lightweight architectural masonry units 150. These clips have a slim profile that allows adjacent lightweight architectural masonry units 150 to be separated by only a narrow gap g (e.g., about ⅝ inch) that is sufficient to enable the fasteners which attach to the structure of the building to be installed through the gap g. For example, this condition can occur when the last lightweight architectural masonry unit 150 is being installed and there is no sideways access to a side of the stone. Alternatively, if a stone has broken in transportation and the installer wishes to put the rest of the stone panels in place while waiting, the web clip 130 provides the flexibility needed. The web clip 130 is pre-installed an edge of the lightweight architectural masonry unit 150 as shown in FIG. 7A, and then after the stone is lifted into place the structure fasteners are attached through the gap g as shown in FIG. 7B. Depending on the size of the lightweight architectural masonry unit 150, this attachment can require the use of a screwgun extension to position the fasteners. This coupling configuration can thus be specifically valuable in arrangements in which only a narrow space can be used. In a similar arrangement, in an embodiment shown in FIG. 8, the modified web clip 130 includes an additional spacer flange 133 to positively establish the joint spacing between the adjacent lightweight architectural masonry units 150 as shown in FIG. 9.

Figure 10A:
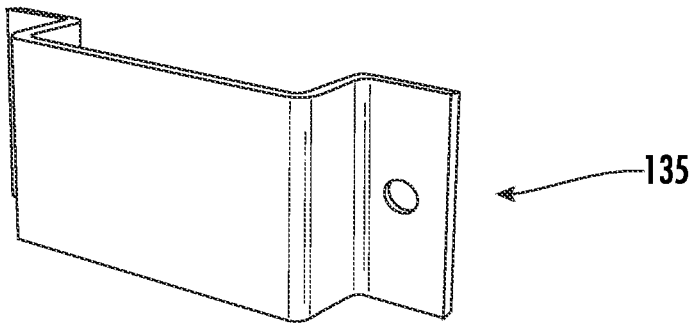
FIGS. 10A through 13 are various views of elements of corresponding cuff and hook elements for connector assemblies according to embodiments of the presently disclosed subject matter.
Figure 10B:
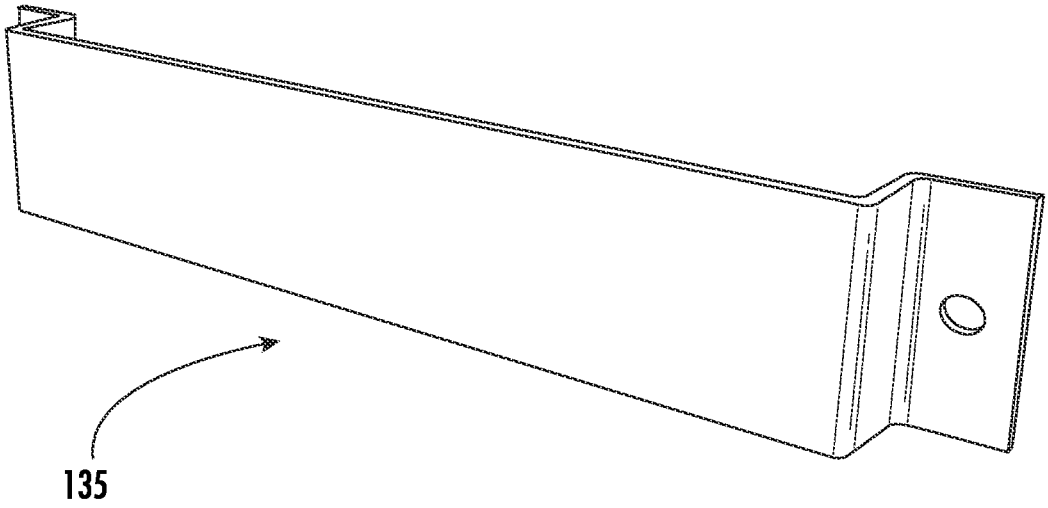
Figure 11:
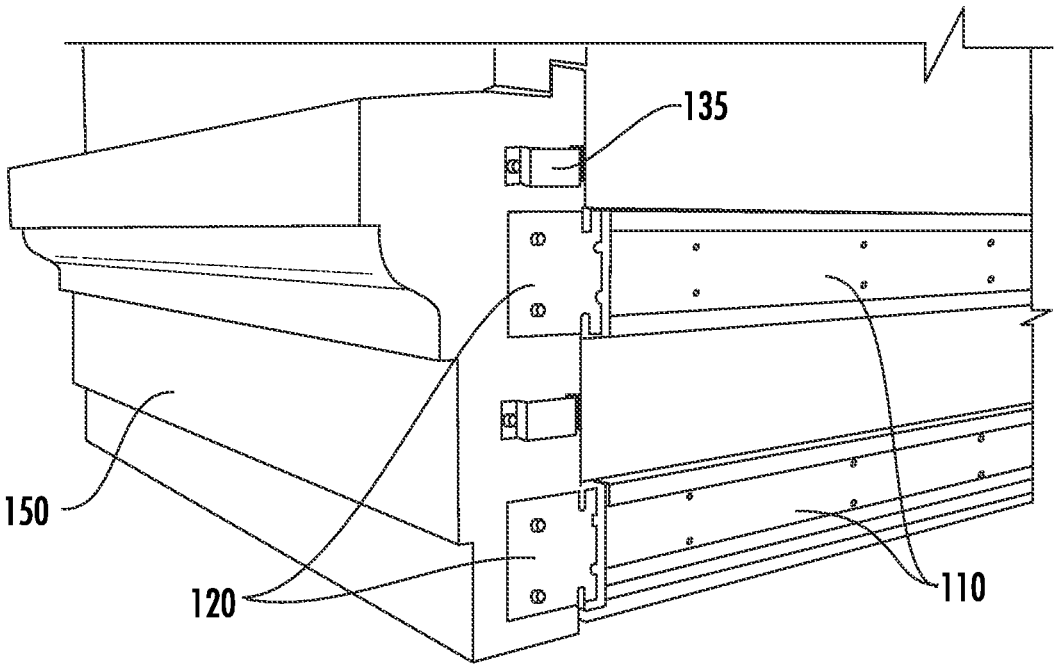
Figure 12A:
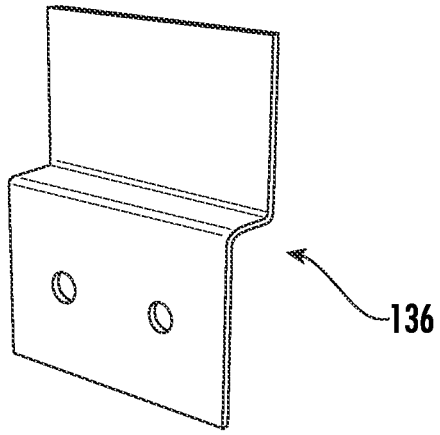
Figure 12B:
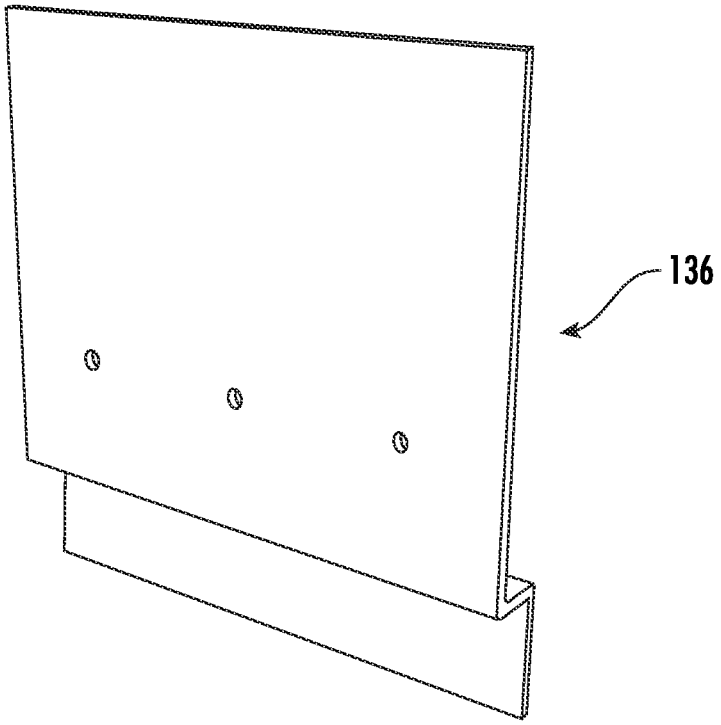
Figure 13:
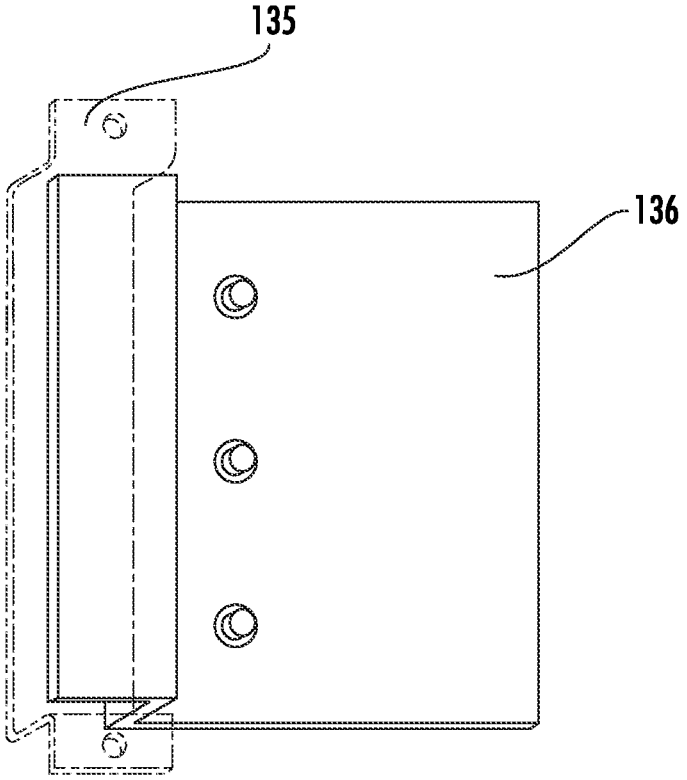

In a further embodiment shown in FIGS. 10A and 10B, the connector assembly 100 includes cuff members 135 that present alternative points of connection between the one or more lightweight architectural masonry units 150 to a building support structure SS. As illustrated in FIG. 11, for example, one or more cuff member 135 can be attached to one of the one or more lightweight architectural masonry units 150 that is already in position with respect to the elongated track 110 and the building support structure SS. One or more complementary hook clips 136 shown in FIGS. 12A and 12B can then be attached to an adjacent one of the one or more lightweight architectural masonry units 150, and the hook clips 136 can be configured to matingly engage with the cuff members 135 to hold the lightweight architectural masonry units 150 together. These two clips used together form a hook-and-cuff type of attachment option, such as is shown in FIG. 13. In this condition, the cuff member 135 is attached to the stone face while the hook clip 136 would be connected to the mating face of the piece which comes from the right side of the building corner shown. In some particular arrangements, this combination of connectors can be used to enable a lightweight architectural masonry unit 150 to be slid into a locking position. Depending on the arrangement of the cuff member 135 and hook clip 136, such installation can allow the lightweight architectural masonry units 150 to slide horizontally towards the elongated track 110, vertically from above the track 110, or in any desired orientation such that each hook clip 136 aligns with and engages the a corresponding cuff member 135. Those having ordinary skill in the art will recognize that the size and arrangement of these elements can be adjusted based on the size and configuration of the lightweight architectural masonry units 150 to be mounted.

Figure 14:
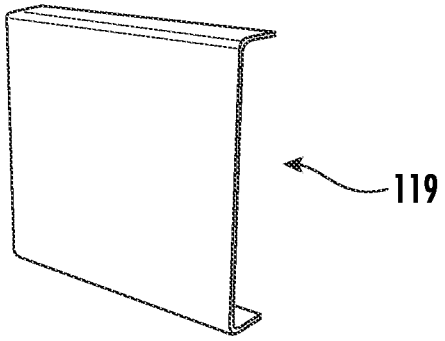
FIG. 14 is a perspective side view of a fixation member for a connector assembly according to an embodiment of the presently disclosed subject matter.
Figure 15:
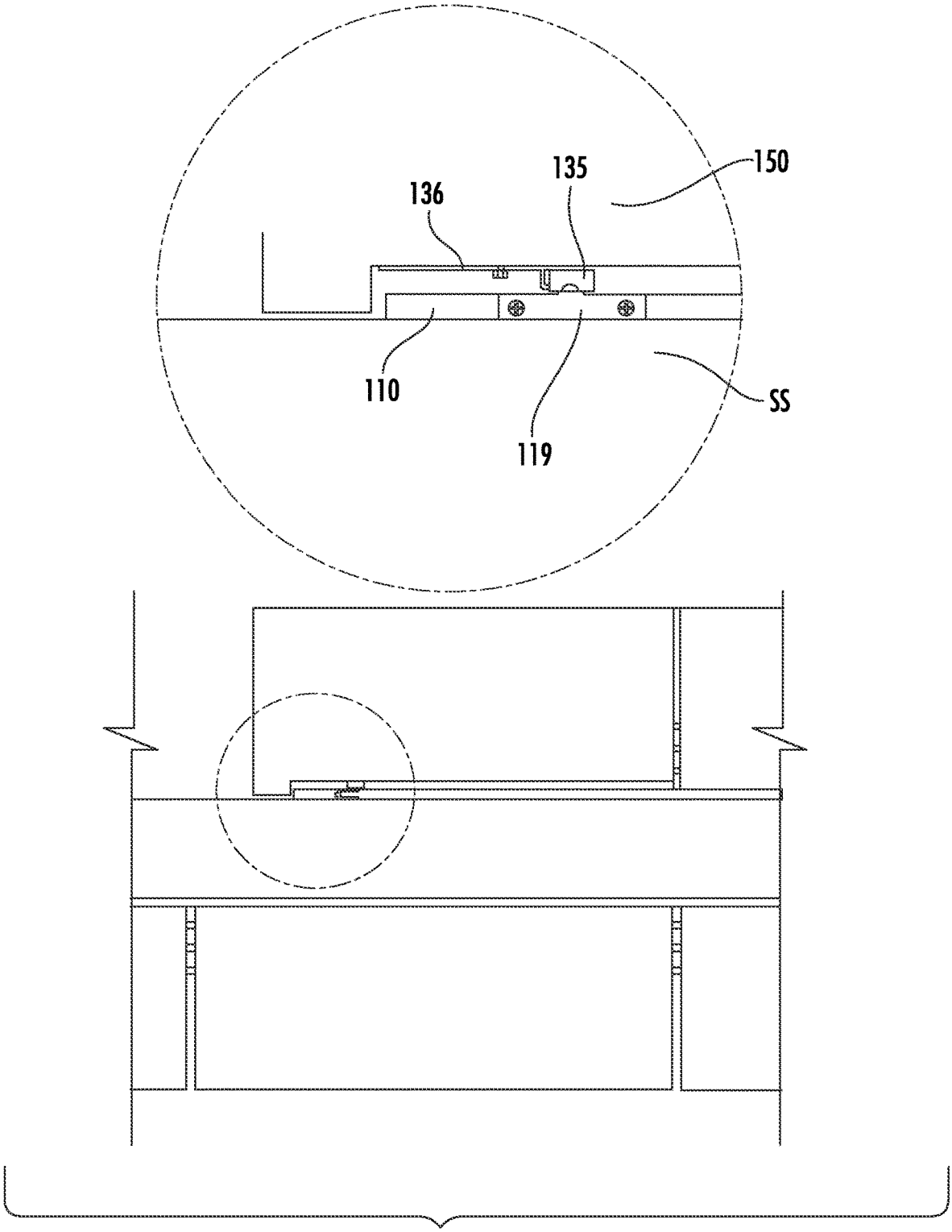
FIG. 15 is a top pan view of a connector assembly according to an embodiment of the presently disclosed subject matter.

Alternatively or in addition, referring to FIGS. 14 and 15, in some embodiments, a track clip 119 can enable attachment in a few unique situations where a connection is required in a certain configuration on the outside face of the track 110. This is an example of how the design of the connector assembly 100 can be configured to remain hidden behind the architectural masonry unit 150. In some embodiments, a lightweight architectural masonry unit 150 can be attached to the track clip 141, and the track clip 121 can be attached to the elongated track 110 to effectively affix the lightweight architectural masonry unit 150 to the elongated track 110 by capping the channels 115. By capping the track 110 with the track clip 121 in this way, the portion of the elongated track 110 aligned with the edge of the lightweight architectural masonry unit 150 is unoccupied, and thus the installer has a larger and simpler surface into which to drive the structure fasteners for further fixation members as discussed herein.

Figure 16A:
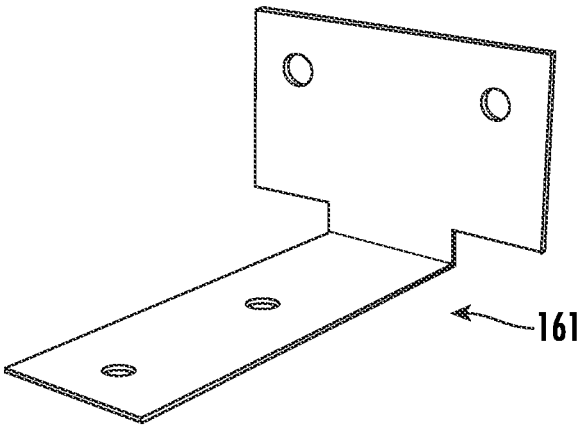
FIGS. 16A through 16H are perspective side views of trim clips for use with connector assemblies according to embodiments of the presently disclosed subject matter.
Figure 16B:
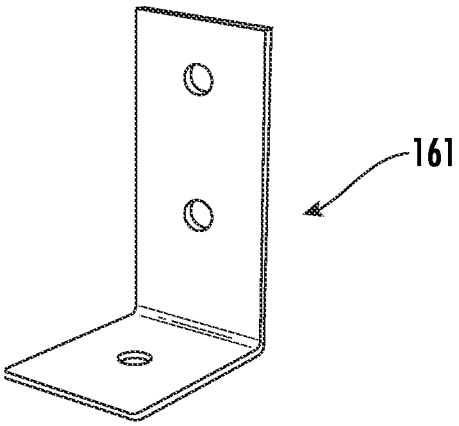
Figure 16C:
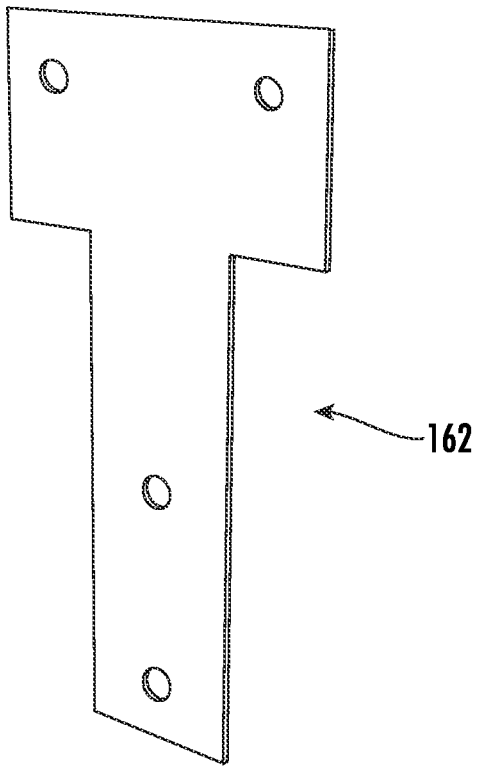
Figure 16D:
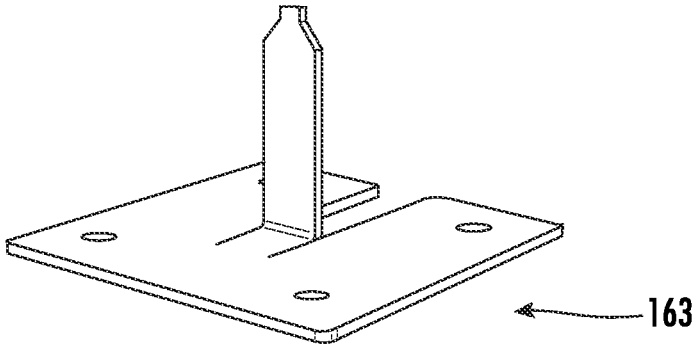
Figure 16E:
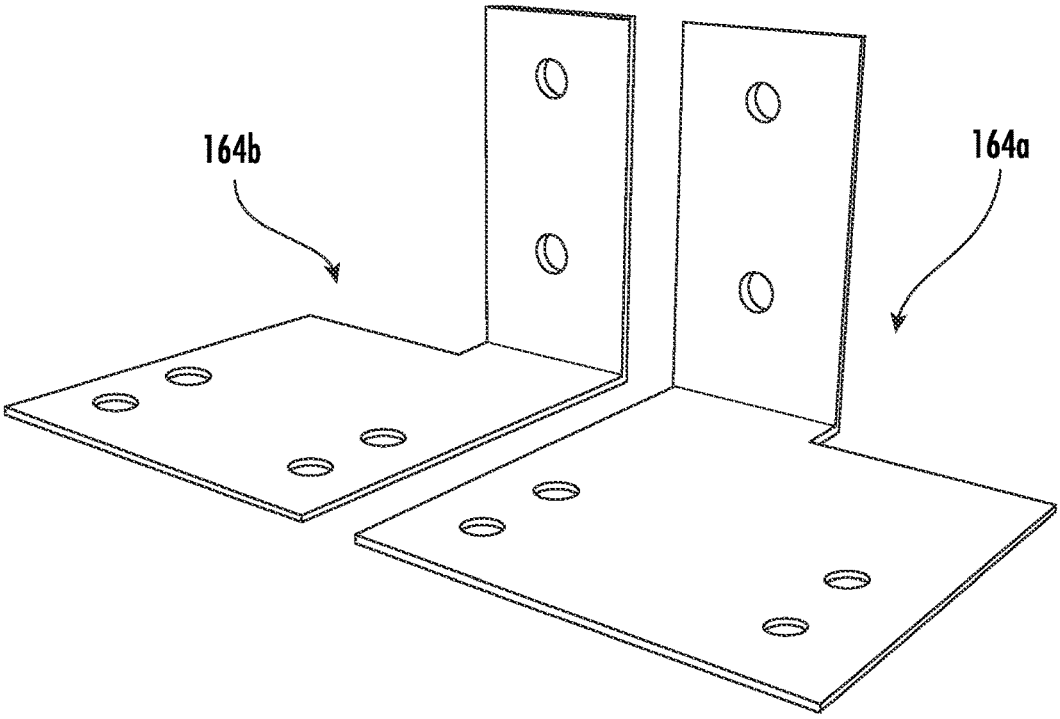
Figure 16F:
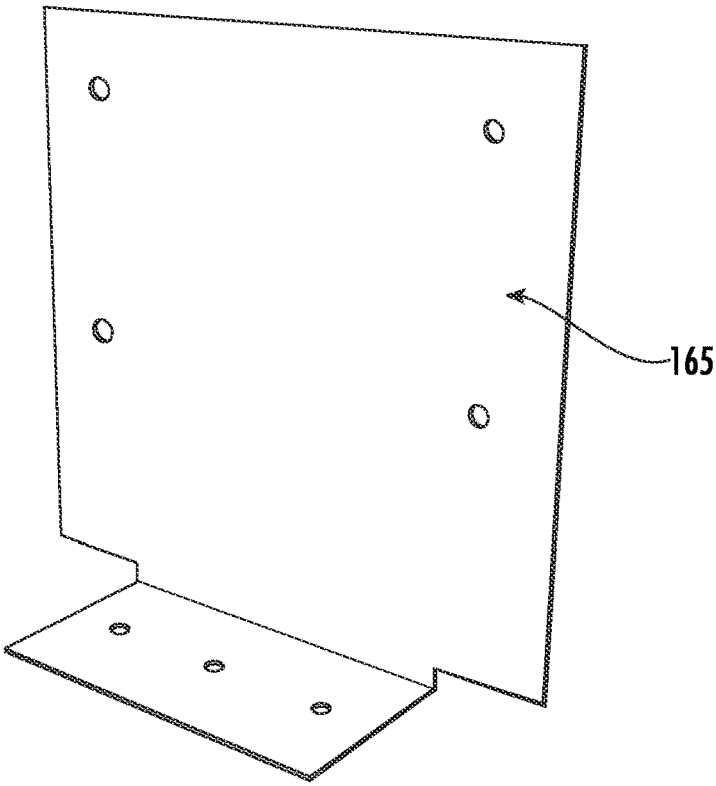
Figure 16G:
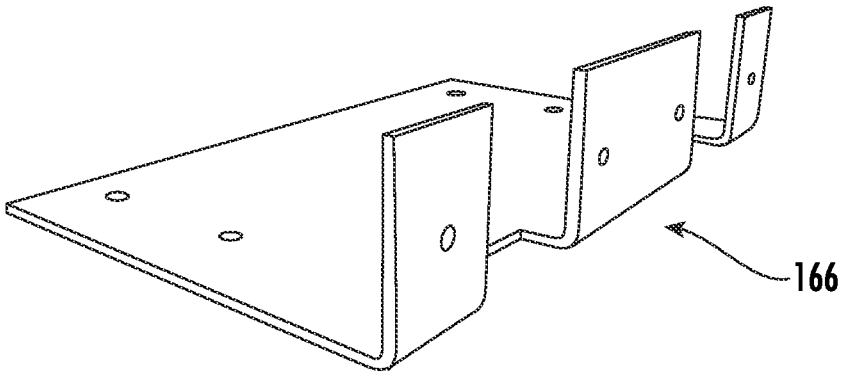
Figure 16H:
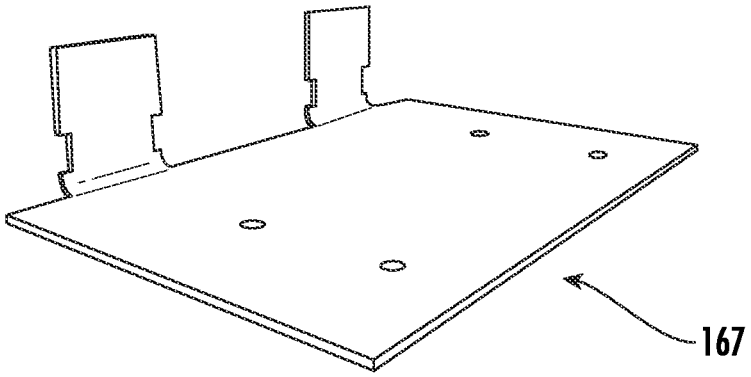
Figure 17:
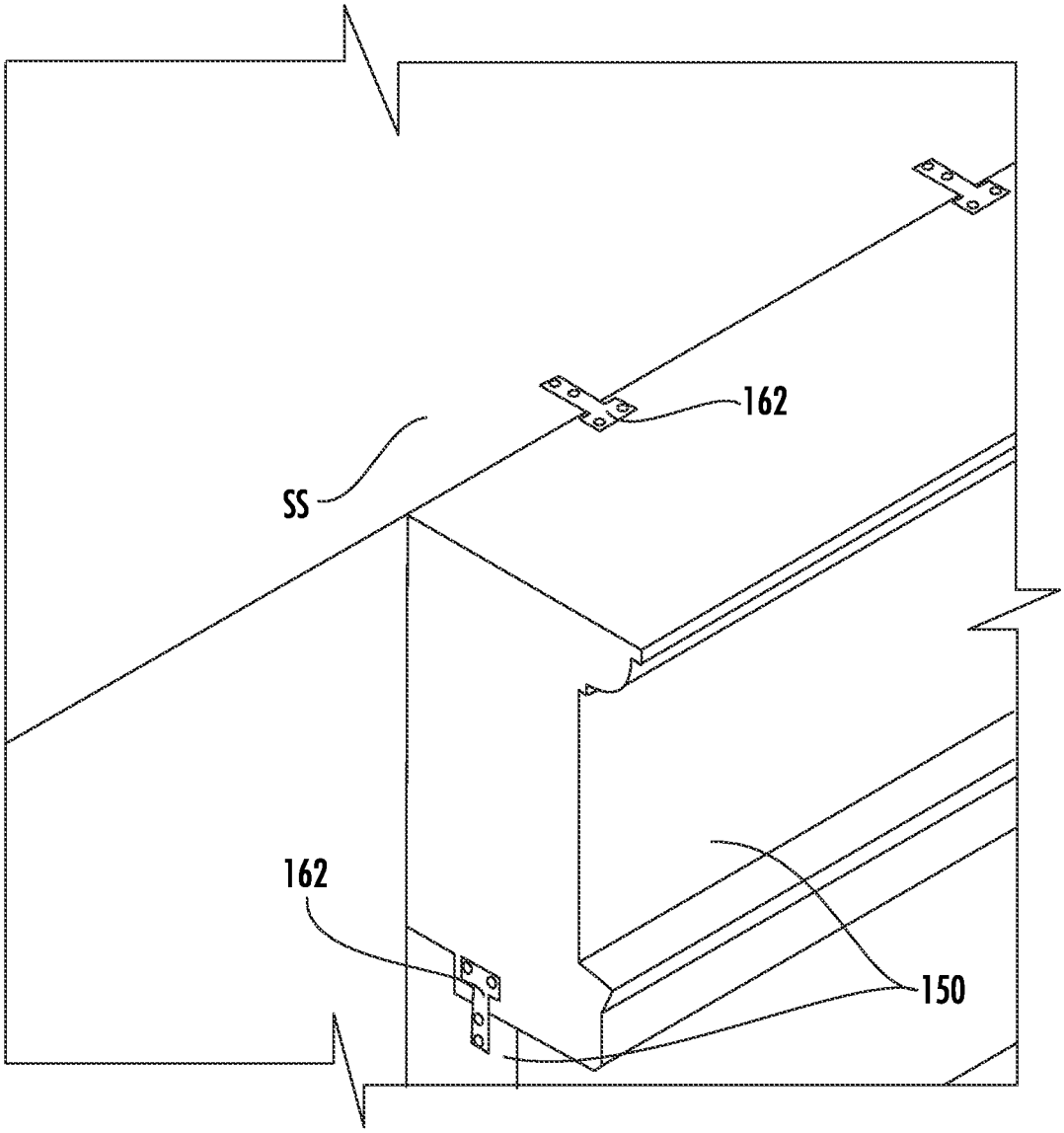
FIGS. 17 through 19 are perspective side views.

In yet further embodiments, the connector assemblies 100 discussed herein can include further specialty connectors that are adapted for use with the elongated track 110 as discussed above or individually to secure a lightweight architectural masonry unit 150 to the exterior of structures, such as in configurations for mounting arches or curved elements or where the elongated track 110 is a non-ideal fit. Alternatively or in addition, such specialty connectors can be used to hold a lightweight architectural masonry unit 150 in place while installing it using the connector assemblies 100 discussed above and/or to provide supplementary support for a lightweight architectural masonry unit 150 in non-standard configurations (e.g., where standing off of the structural support is greater than 30 inches). Such connectors can include the trim clips shown in FIGS. 16A through 16H. For example, various embodiments of an angle trim clip 161 are shown in FIGS. 16A and 16B, such connectors being usable to facilitate a number of different attachment options for special trim pieces. The configurations of the angle trim clip 161 can function to attach a lightweight architectural masonry unit 150 directly to a support structure SS, attach a lightweight architectural masonry unit 150 to another lightweight architectural masonry unit 150, or it can be used as a dowel, allowing the vertical tab to help keep the panel piece in place without the use of fasteners. A straight trim clip 162 is shown in FIG. 16C and can be used to connect elements that have surfaces that are aligned substantially flush to one another, such as in the arrangement shown in FIG. 17. A tabbed trim clip 163 shown in FIG. 16D can be used in various places where the lightweight architectural masonry unit 150 needs to be held in place. A hole can be formed into the stone shell of the lightweight architectural masonry unit 150, and the tab sticking up out of the tabbed trim clip 163 slips into the stone shell and holds it in place.

Figure 18:
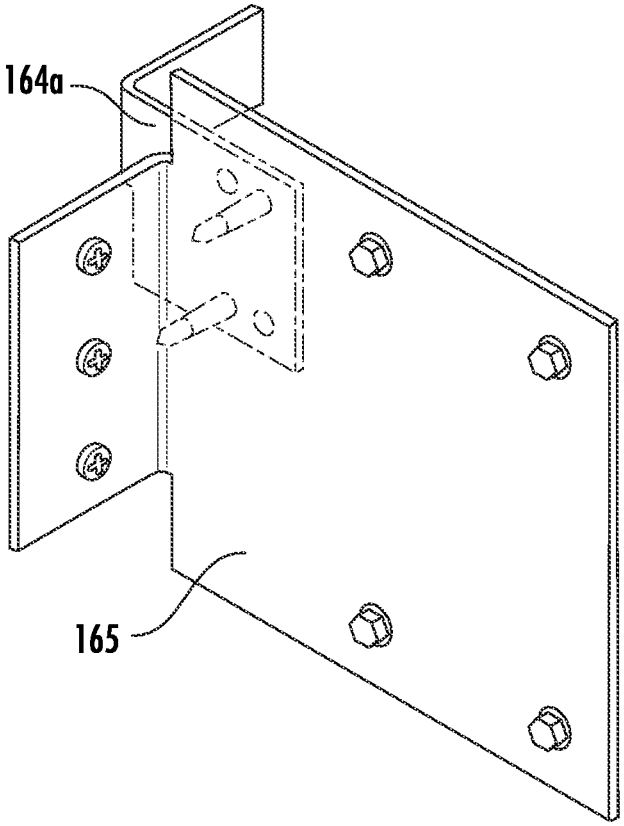
Figure 19:
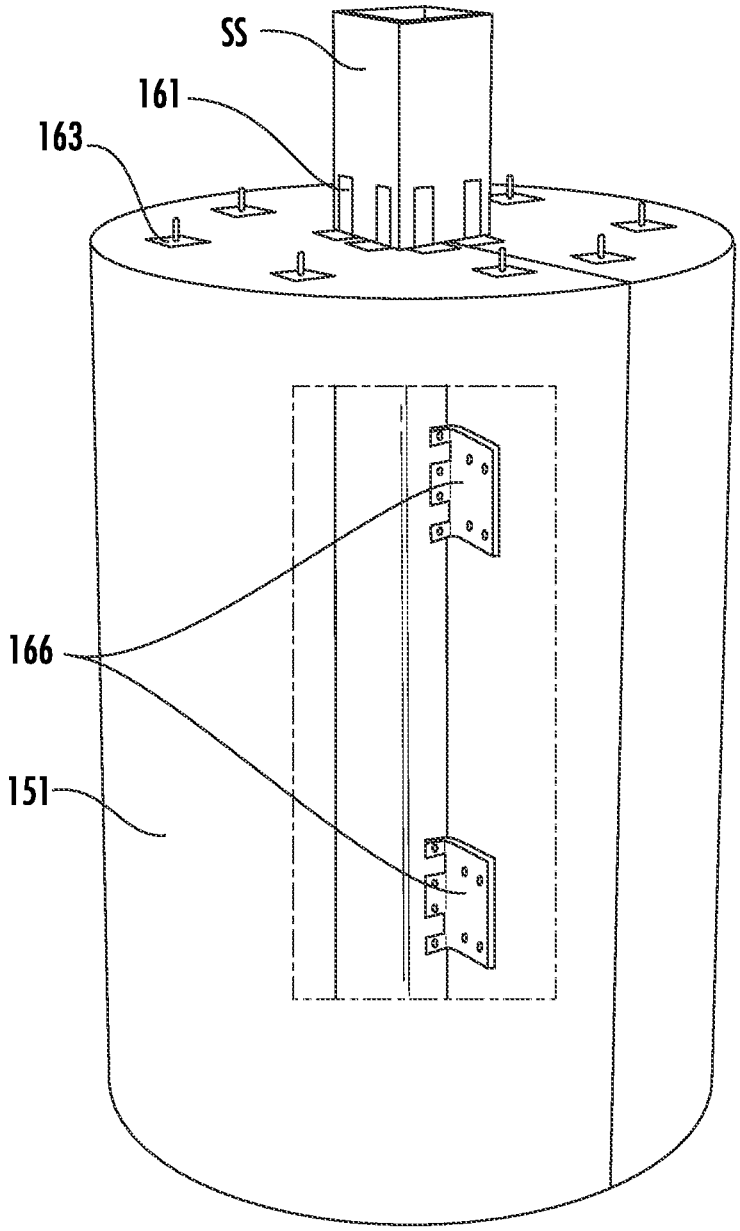

Further connector elements can also be provided, individually or in paired combinations, for other special circumstances. For example, a "left-hand" trim clip 164*a* or a "right-hand" trim clip 164*b* shown in FIG. 16E can be used together with each other and/or in combination with other elements in a variety of orientations to interlace with each other or with other clips to resolve challenges associated with mounting stone pieces in locations with limited access. For example, either of the "left-hand" trim clip 164*a* or the "right-hand" trim clip 164*b* can be used with a panel trim clip 165 shown in FIG. 16F to complementarily mount adjacent stone structures to the building support structure, such as is shown in FIG. 18. Similarly, a first interlock trim clip 166 shown in FIG. 16G and a second interlock trim clip 167 shown in FIG. 16H can be arranged to interlace with each other to complementarily mount adjacent stone structures to the building support structure. In some embodiments of such interlacing configurations, the clips can be positioned such that the attachment to the structural support SS of the first-installed of the clips (e.g., panel trim clip 165 in FIG. 18) is oriented vertically below the complementary clip (e.g. the "left-hand" trim clip 164*a* in FIG. 18) so that the dead load of the second-installed complementary clip is supported by the first-installed clip. In such arrangements, the second-installed clip need not be secured to the structural support SS separately by fasteners but can instead be held in place by a combination of this vertical dead load support and a friction fit of the second-installed clip behind the first-installed clip.

Figure 20:
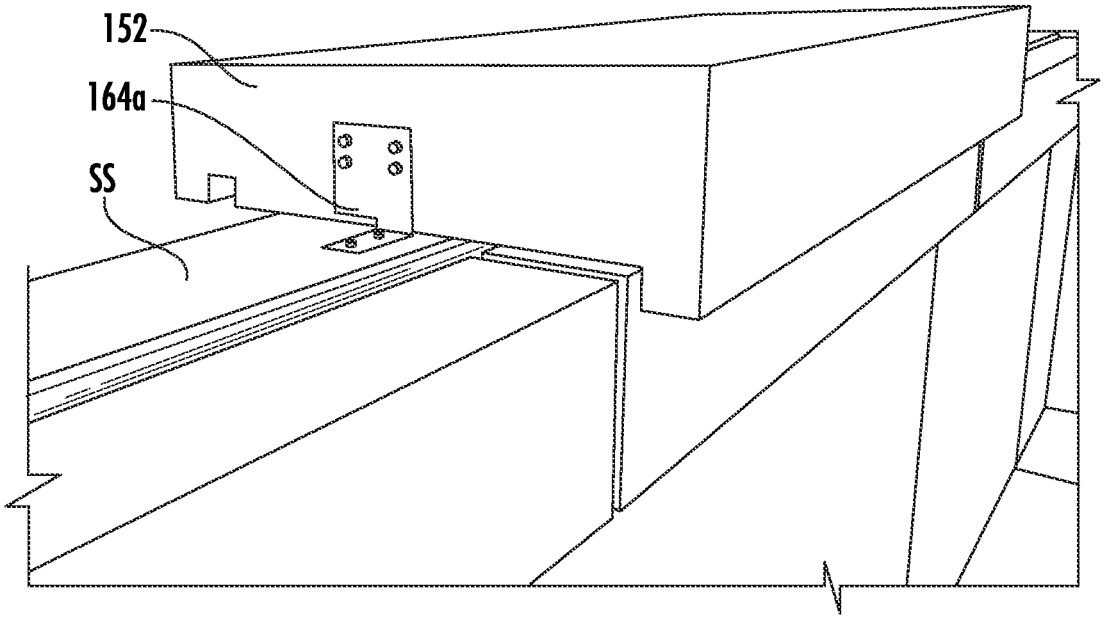
FIG. 20 is a plan view of connector assemblies according to embodiments of the presently disclosed subject matter.
Figure 21:
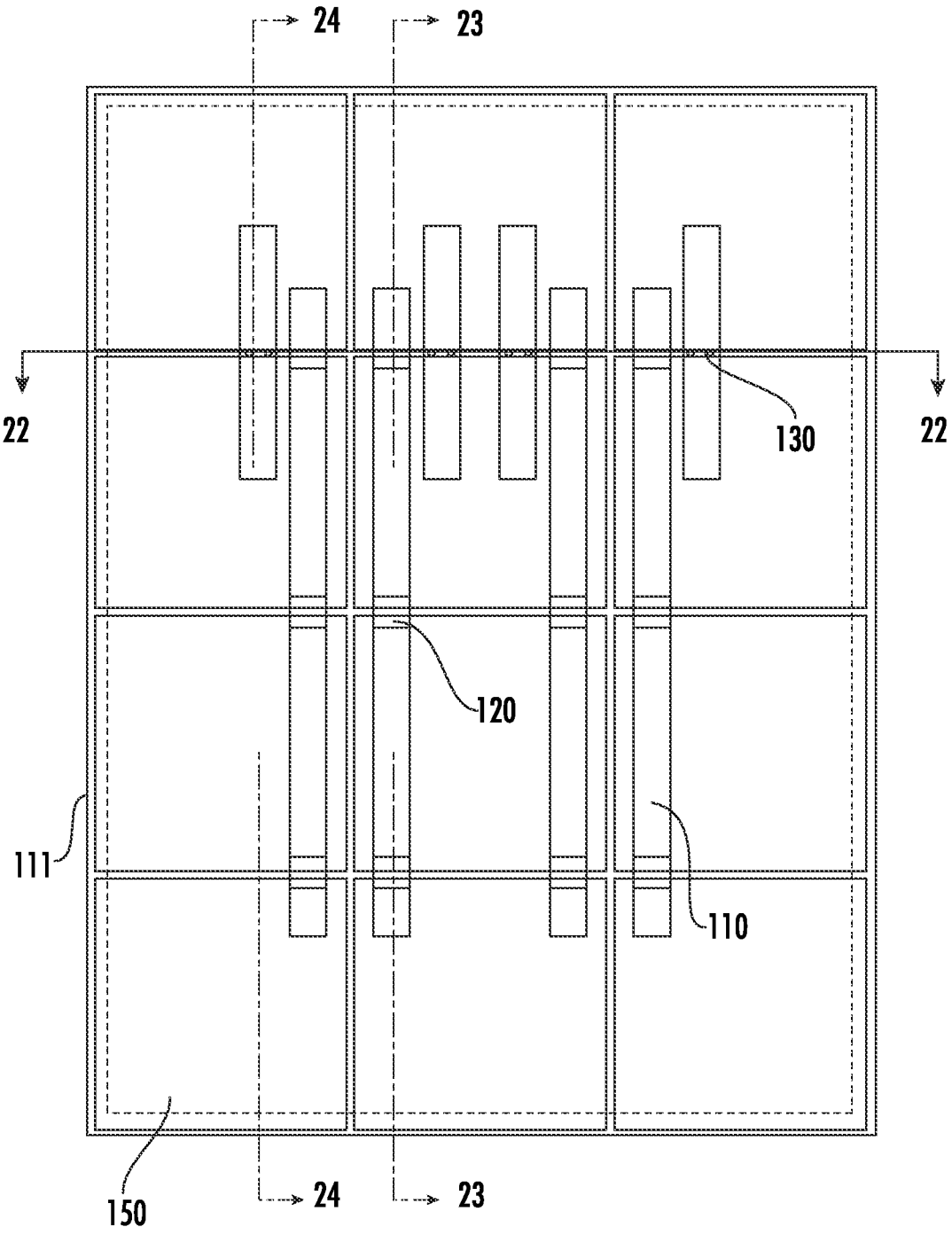
FIG. 21 is a top plan view of connector assemblies according to an embodiment of the presently disclosed subject matter.
Figure 22:
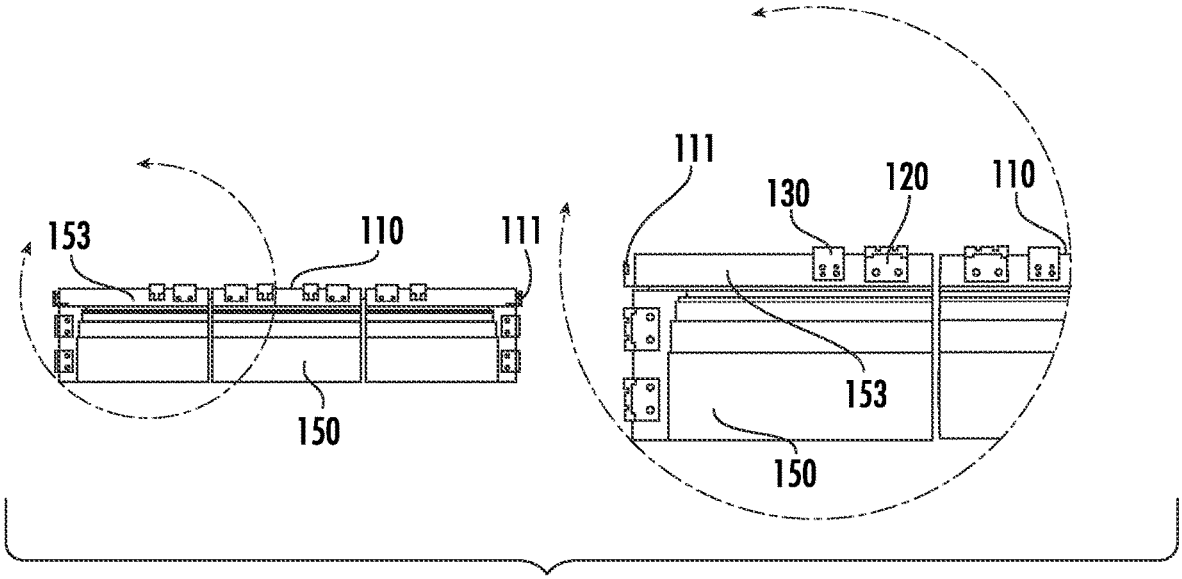
FIGS. 22-24 are side sectional views of connector assemblies according to the embodiment shown in FIG. 21.
Figure 23:
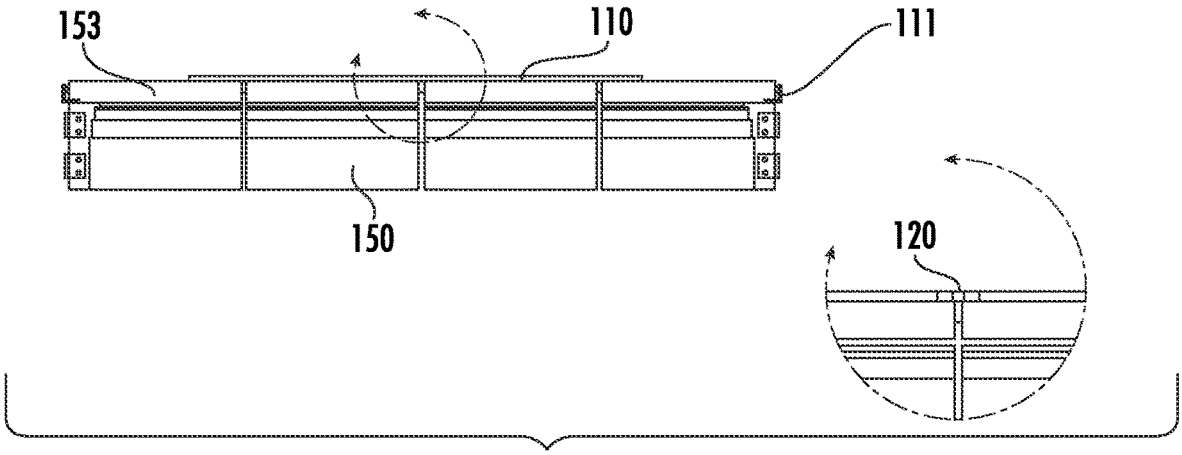
Figure 24:
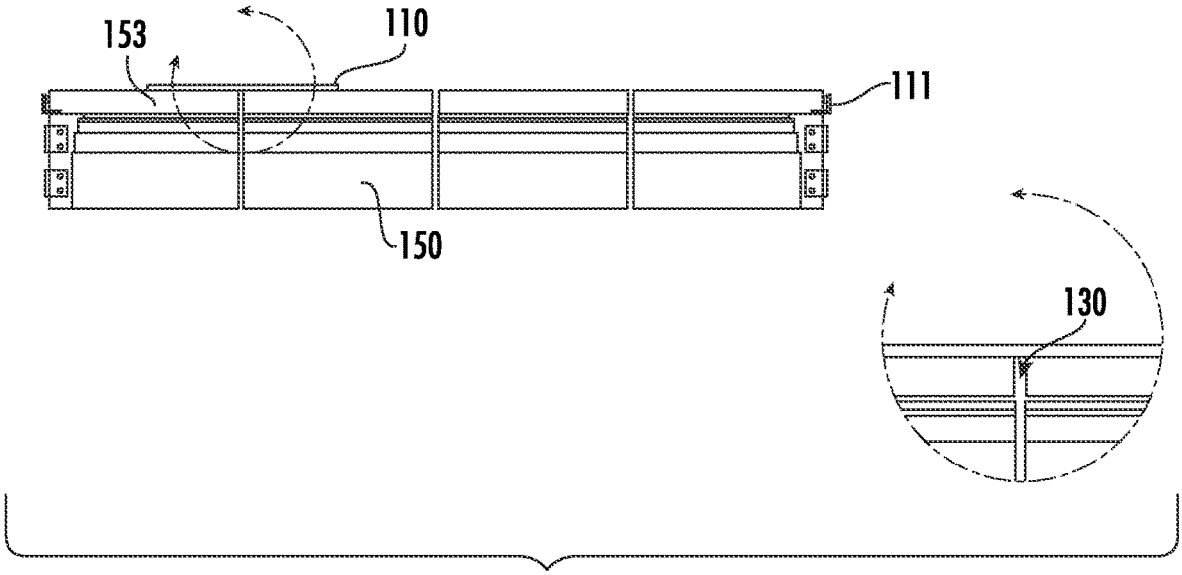
Figure 25:
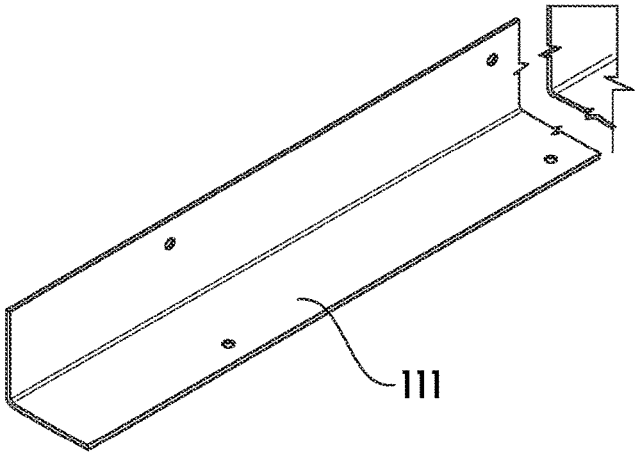
FIG. 25 is a perspective side view of an edge support according to an embodiment of the presently disclosed subject matter

Such configurations for the present connector assembly can thus be selected for mounting lightweight architectural masonry units such as lightweight masonry column elements 151, lightweight outside corner elements 152, and lightweight masonry soffits 153 as shown in FIGS. 19 through 23. In one particular configuration shown in FIG. 19, for example, different configurations of trim clips are used to assist in the attachment of a round lightweight masonry column elements 151 to an underlying structural column. In addition, a first interlock trim clip 166 and a second interlock trim clip 167 shown in FIGS. 16G and 16H, respectively, can be used in conjunction to connect lightweight masonry column elements 151 (e.g., filled with an EPS core) to the structural column. The notched design enables the clips to lock into each other for fast installation. In further example implementations, FIG. 20 shows an installation of a parapet cap, and FIGS. 21 through 24 shows aspects of an installation of a suspended soffit and/or ceiling. As shown in FIG. 21, in some embodiments, an edge support 111 shown in FIG. 25 can be secured to a wall perimeter to support the lightweight masonry soffits 153.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A connector assembly for mounting one or more lightweight architectural masonry units to a building support structure, the connector assembly comprising:

an elongated track having a web and opposed edge portions that extend in a first direction from a first surface of the web and that form a pair of slide channels, the elongated track being configured to be mounted to the building support structure;

a connecting member including a base portion and a flange portion, the base portion being configured to retain the connecting member to the channels but is movable within the channels along the track, and the flange portion being configured to connect to a first lightweight architectural masonry unit of the one or more lightweight architectural masonry units, wherein the flange portion comprises one or more holes configured to receive a corresponding one or more fasteners that are configured for attachment to the first lightweight architectural masonry unit; and a fixation member having a first end configured to connect to the elongated track and a second end configured to connect to the lightweight architectural masonry unit, the fixation member configured to retain the first lightweight architectural masonry unit in place with respect to the elongated track.

2. The connector assembly of claim 1, wherein the connecting member is configured to engage a side-facing surface of the lightweight architectural masonry unit.

3. The connector assembly of claim 1, wherein the base portion comprises notches configured to establish intermittent openings between the base portion and the web of the elongated track;

wherein the notches are sized to accommodate fasteners for attaching the elongated track to the building support structure.

4. The connector assembly of claim 1, wherein the one or more holes in the flange portion comprises one or more slots configured to receive the corresponding one or more fasteners that are configured for attachment to the first lightweight architectural masonry unit, wherein the one or more fasteners are movable within the one or more slots to allow for vertical deflection of the first lightweight architectural masonry unit relative to the elongated track.

5. The connector assembly of claim 1, wherein the flange portion is arranged at an oblique angle relative to the base portion.

6. The connector assembly of claim 1, wherein the first end of the fixation member is configured to engage an edge portion of the elongated track.

7. The connector assembly of claim 1, wherein the first end of the fixation member is configured to engage the web of the elongated track.

8. The connector assembly of claim 7, wherein the second end of the fixation member comprises a spacer flange configured to establish a gap between the first lightweight architectural masonry unit and an adjacent one of the one or more lightweight architectural masonry units.

9. The connector assembly of claim 1, wherein the second end of the fixation member is configured to engage a surface of the first lightweight architectural masonry unit that faces the elongated track.

10. The connector assembly of claim 1, wherein the second end of the fixation member is configured to engage a surface of the first lightweight architectural masonry unit that faces an adjacent one of the one or more lightweight architectural masonry units.

11. The connector assembly of claim 1, comprising:

a cuff member configured to be attached to a surface of the first lightweight architectural masonry unit that faces an adjacent one of the one or more lightweight architectural masonry units; and a hook clip configured to be attached to a surface of the adjacent one of the one or more lightweight architectural masonry units that faces the first lightweight architectural masonry unit;

wherein the cuff member and the hook clip are configured to matingly engage to hold the first lightweight architectural masonry unit and the adjacent one of the one or more lightweight architectural masonry units together.

12. An assembly of one or more lightweight architectural masonry units configured for mounting to a building support structure, the assembly comprising:

an elongated track having a web and opposed edge portions that extend in a first direction from a first surface of the web and that form a pair of slide channels, the elongated track being configured to be mounted to the building support structure;

a connecting member including a base portion and a flange portion, the base portion being configured to retain the connecting member to the channels but is movable within the channels along the track, wherein the flange portion comprises one or more holes;

a first lightweight architectural masonry unit of the one or more lightweight architectural masonry units that is attached to the flange portion of the connecting member by one or more fasteners correspondingly received in the one or more holes of the flange portion; and a fixation member having a first end connected to the elongated track and a second end connected to the lightweight architectural masonry unit, the fixation member configured to retain the first lightweight architectural masonry unit in place with respect to the elongated track.

13. The assembly of claim 12, wherein the connecting member is configured to engage a side-facing surface of the lightweight architectural masonry unit.

14. The assembly of claim 12, wherein the base portion comprises notches configured to establish intermittent openings between the base portion and the web of the elongated track;

wherein the notches are sized to accommodate fasteners for attaching the elongated track to the building support structure.

15. The assembly of claim 12, wherein the one or more holes of the flange portion comprises one or more slots, and wherein the one or more fasteners are movable within the one or more slots to allow for vertical deflection of the first lightweight architectural masonry unit relative to the elongated track.

16. The assembly of claim 12, wherein the flange portion is arranged at an oblique angle relative to the base portion.

17. The assembly of claim 12, wherein the first end of the fixation member engages an edge portion of the elongated track.

18. The assembly of claim 12, wherein the first end of the fixation member engages the web of the elongated track.

19. The assembly of claim 18, wherein the second end of the fixation member comprises a spacer flange configured to establish a gap between the first lightweight architectural masonry unit and an adjacent one of the one or more lightweight architectural masonry units.

20. The assembly of claim 12, wherein the second end of the fixation member engages a surface of the first lightweight architectural masonry unit that faces the elongated track.

21. The assembly of claim 12, wherein the second end of the fixation member engages a surface of the first lightweight architectural masonry unit that faces an adjacent one of the one or more lightweight architectural masonry units.

22. The assembly of claim 12, comprising:

a cuff member attached to a surface of the first lightweight architectural masonry unit that faces an adjacent one of the one or more lightweight architectural masonry units; and a hook clip configured to be attached to a surface of the adjacent one of the one or more lightweight architectural masonry units that faces the first lightweight architectural masonry unit;

wherein the cuff member and the hook clip are configured to matingly engage to hold the first lightweight architectural masonry unit and the adjacent one of the one or more lightweight architectural masonry units together.

23. A method for mounting one or more lightweight architectural masonry units to a building support structure, the method comprising:

mounting an elongated track to the building support structure, the elongated track being having a web and opposed edge portions that extend in a first direction from a first surface of the web and that form a pair of slide channels;

positioning a connecting member in the slide channels, the connecting member including a base portion and a flange portion, the base portion retaining the connecting member to the channels but being movable within the channels along the track, wherein the flange portion comprises one or more holes;

connecting the flange portion of the connecting member to a first lightweight architectural masonry unit of the one or more lightweight architectural masonry units by one or more fasteners correspondingly received in the one or more holes of the flange portion to attach the first lightweight architectural masonry unit to the flange portion; and connecting a first end of a fixation member to the elongated track and connecting a second end of the fixation member to the lightweight architectural masonry unit, the fixation member retaining the first lightweight architectural masonry unit in place with respect to the elongated track.

24. The method of claim 23, wherein the connecting member is configured to engage a side-facing surface of the lightweight architectural masonry unit.

25. The method of claim 23 wherein the base portion comprises notches configured to establish intermittent openings between the base portion and the web of the elongated track;

wherein the notches are sized to accommodate fasteners for attaching the elongated track to the building support structure.

26. The method of claim 23, wherein the one or more holes of the flange portion comprises one or more slots configured to receive the corresponding one or more fasteners, wherein the one or more fasteners are movable within the one or more slots to allow for vertical deflection of the first lightweight architectural masonry unit relative to the elongated track.

27. The method of claim 23, wherein the flange portion is arranged at an oblique angle relative to the base portion.

28. The method of claim 23, wherein the first end of the fixation member engages an edge portion of the elongated track.

29. The method of claim 23, wherein the first end of the fixation member engages the web of the elongated track.

30. The method of claim 29, wherein the second end of the fixation member comprises a spacer flange that establishes a gap between the first lightweight architectural masonry unit and an adjacent one of the one or more lightweight architectural masonry units.

31. The method of claim 23, wherein the second end of the fixation member engages a surface of the first lightweight architectural masonry unit that faces the elongated track.

32. The method of claim 23, wherein the second end of the fixation member engages a surface of the first lightweight architectural masonry unit that faces an adjacent one of the one or more lightweight architectural masonry units.

33. The method of claim 23, comprising:

attaching a cuff member to a surface of the first lightweight architectural masonry unit that faces an adjacent one of the one or more lightweight architectural masonry units; and attaching a hook clip to a surface of the adjacent one of the one or more lightweight architectural masonry units that faces the first lightweight architectural masonry unit;

wherein the cuff member and the hook clip matingly engage to hold the first lightweight architectural masonry unit and the adjacent one of the one or more lightweight architectural masonry units together.

* * * * *